US008731212B2

(12) United States Patent
Takahashi et al.

(10) Patent No.: US 8,731,212 B2
(45) Date of Patent: May 20, 2014

(54) SOUND COLLECTING DEVICE, ACOUSTIC COMMUNICATION SYSTEM, AND COMPUTER-READABLE STORAGE MEDIUM

(75) Inventors: Katsuyuki Takahashi, Tokyo (JP); Masashi Takada, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 621 days.

(21) Appl. No.: 12/923,210

(22) Filed: Sep. 9, 2010

(65) Prior Publication Data

US 2011/0069847 A1 Mar. 24, 2011

(30) Foreign Application Priority Data

Sep. 24, 2009 (JP) ..... 2009-219741

(51) Int. Cl.
*H04R 3/00* (2006.01)

(52) U.S. Cl.
USPC ..... 381/92; 381/91; 381/122; 381/94.1; 381/97

(58) Field of Classification Search
USPC ..... 381/92, 91, 97, 98, 102, 100, 86, 95, 381/93, 56, 57, 26, 313, 320, 123, 23.1, 61, 381/312, 316, 317, 71.1, 71.3, 71.4, 71.7, 381/71.11, 71.12, 71.14, 74, 94.1, 94.2, 381/94.3, 94.4, 94.5, 94.7, 101, 122
See application file for complete search history.

(56) References Cited

U.S. PATENT DOCUMENTS 6,339,758 B1 * 1/2002 Kanazawa et al. ..... 704/226
7,324,649 B1 * 1/2008 Knapp et al. ..... 381/313

FOREIGN PATENT DOCUMENTS

JP 2007-013400 A 1/2007
JP 2007013400 A * 1/2007
JP 2007-116585 A 5/2007
JP 2008-061186 A 3/2008
JP 2008-288910 A 11/2008

OTHER PUBLICATIONS

Japanese Office Action dated Apr. 2, 2013, issued in corresponding Japanese Patent Application.

* cited by examiner

*Primary Examiner* — Leshui Zhang
(74) *Attorney, Agent, or Firm* — Rabin & Berdo, P.C.

(57) ABSTRACT

There is provided a sound collecting device, including: an orientation direction forming section that forms an orientation direction of a microphone array; and a control section that, when a characteristic in a frequency band of a synthesized signal obtained by synthesizing the acoustic signals corresponds to a characteristic of an acoustic signal corresponding to a sound other than a target sound, controls the orientation direction forming section such that an orientation direction that is a direction that is different than an orientation direction of the microphone array at a present point in time is formed, and, when the characteristic in the frequency band of the synthesized signal does not correspond to a characteristic of an acoustic signal corresponding to a sound other than the target sound, controls the orientation direction forming section such that the orientation direction of the microphone array is maintained.

8 Claims, 16 Drawing Sheets

FIG. 2

| DIRECTION INFORMATION | DELAY TIME INFORMATION |
|---|---|
| DIRECTION A | DELAY TIMES $A_1$ THROUGH $A_{14}$ |
| DIRECTION B | DELAY TIMES $B_1$ THROUGH $B_{14}$ |
| DIRECTION C | DELAY TIMES $C_1$ THROUGH $C_{14}$ |

FIG. 4

| NOISE TYPE INFORMATION | VOICED SOUND NUMBER OF TIMES | | | | FREQUENCY OF OCCURRENCE | WEIGHT VALUE | OCCURRING NUMBER OF TIMES | COMPARISON PRIORITY LEVEL |
|---|---|---|---|---|---|---|---|---|
| | FREQUENCY BAND A | FREQUENCY BAND B | FREQUENCY BAND C | FREQUENCY BAND D | | | | |
| NOISE A | 0 TIMES | 5 TIMES | 0 TIMES | 5 TIMES | 9.6 | 1.2 | 8 | 1 |
| NOISE B | 10 TIMES | 0 TIMES | 10 TIMES | 0 TIMES | 9 | 1.8 | 5 | 2 |
| NOISE C | 20 TIMES | 25 TIMES | 30 TIMES | 35 TIMES | 4.5 | 1.5 | 3 | 3 |

FIG. 8

| NOISE TYPE INFORMATION | DIRECTION INFORMATION | VOICED SOUND NUMBER OF TIMES | | | | FREQUENCY OF OCCURRENCE | WEIGHT VALUE | OCCURRING NUMBER OF TIMES | COMPARISON PRIORITY LEVEL |
|---|---|---|---|---|---|---|---|---|---|
| | | FREQUENCY BAND A | FREQUENCY BAND B | FREQUENCY BAND C | FREQUENCY BAND D | | | | |
| NOISE A | DIRECTION A | 10 TIMES | 0 TIMES | 10 TIMES | 0 TIMES | 9 | 1.8 | 5 | 2 |
| | DIRECTION B | 11 TIMES | 0 TIMES | 11 TIMES | 0 TIMES | 4.5 | 1.5 | 3 | 2 |
| | DIRECTION C | 9 TIMES | 0 TIMES | 9 TIMES | 0 TIMES | 4.0 | 1.0 | 4 | 1 |
| NOISE B | DIRECTION A | 0 TIMES | 5 TIMES | 0 TIMES | 5 TIMES | 9.6 | 1.2 | 8 | 1 |
| | DIRECTION B | 0 TIMES | 4 TIMES | 0 TIMES | 4 TIMES | 3.0 | 1.5 | 2 | 3 |
| | DIRECTION C | 0 TIMES | 3 TIMES | 0 TIMES | 3 TIMES | 2.0 | 1.0 | 2 | 2 |
| NOISE C | DIRECTION A | 20 TIMES | 25 TIMES | 30 TIMES | 35 TIMES | 4.5 | 1.5 | 3 | 3 |
| | DIRECTION B | 18 TIMES | 23 TIMES | 28 TIMES | 33 TIMES | 8.5 | 1.7 | 5 | 1 |
| | DIRECTION C | 16 TIMES | 21 TIMES | 26 TIMES | 31 TIMES | 1.0 | 1.0 | 1 | 3 |

FIG. 15

DIRECTION A

| NOISE TYPE INFORMATION | VOICED SOUND NUMBER OF TIMES | | | | FREQUENCY OF OCCURRENCE | WEIGHT VALUE | OCCURRING NUMBER OF TIMES | COMPARISON PRIORITY LEVEL |
|---|---|---|---|---|---|---|---|---|
| | FREQUENCY BAND A | FREQUENCY BAND B | FREQUENCY BAND C | FREQUENCY BAND D | | | | |
| NOISE A | 20 TIMES | 5 TIMES | 20 TIMES | 5 TIMES | 9.6 | 1.2 | 8 | 1 |
| NOISE B | 10 TIMES | 0 TIMES | 10 TIMES | 0 TIMES | 9 | 1.8 | 5 | 2 |
| NOISE C | 5 TIMES | 15 TIMES | 0 TIMES | 0 TIMES | 4.5 | 1.5 | 3 | 3 |

DIRECTION B

| NOISE TYPE INFORMATION | VOICED SOUND NUMBER OF TIMES | | | | FREQUENCY OF OCCURRENCE | WEIGHT VALUE | OCCURRING NUMBER OF TIMES | COMPARISON PRIORITY LEVEL |
|---|---|---|---|---|---|---|---|---|
| | FREQUENCY BAND A | FREQUENCY BAND B | FREQUENCY BAND C | FREQUENCY BAND D | | | | |
| NOISE A | 20 TIMES | 5 TIMES | 20 TIMES | 5 TIMES | 8.5 | 1.7 | 5 | 1 |
| NOISE B | 10 TIMES | 0 TIMES | 10 TIMES | 0 TIMES | 4.5 | 1.5 | 3 | 2 |
| NOISE C | 5 TIMES | 15 TIMES | 0 TIMES | 0 TIMES | 3.0 | 1.5 | 2 | 3 |

DIRECTION C

| NOISE TYPE INFORMATION | VOICED SOUND NUMBER OF TIMES | | | | FREQUENCY OF OCCURRENCE | WEIGHT VALUE | OCCURRING NUMBER OF TIMES | COMPARISON PRIORITY LEVEL |
|---|---|---|---|---|---|---|---|---|
| | FREQUENCY BAND A | FREQUENCY BAND B | FREQUENCY BAND C | FREQUENCY BAND D | | | | |
| NOISE A | 20 TIMES | 5 TIMES | 20 TIMES | 5 TIMES | 4.0 | 1.0 | 4 | 1 |
| NOISE B | 10 TIMES | 0 TIMES | 10 TIMES | 0 TIMES | 2.0 | 1.0 | 2 | 2 |
| NOISE C | 5 TIMES | 15 TIMES | 0 TIMES | 0 TIMES | 1.0 | 1.0 | 1 | 3 |

SOUND COLLECTING DEVICE, ACOUSTIC COMMUNICATION SYSTEM, AND COMPUTER-READABLE STORAGE MEDIUM

CROSS-REFERENCE TO RELATED APPLICATION

This application claims priority under 35 USC 119 from Japanese Patent Application No. 2009-219741 filed on Sep. 24, 2009, the disclosure of which is incorporated by reference herein.

BACKGROUND

1. Technical Field

The present invention relates to a sound collecting device, an acoustic communication system and a computer-readable storage medium, and in particular, to a sound collecting device, an acoustic communication system and a computer-readable storage medium that can form directivity by delaying and synthesizing respective acoustic signals obtained by collecting sound by plural sound-collecting microphones.

2. Related Art

Adaptive beamforming is known as a technique of estimating a direction in which there exists a sound source (hereinafter called "target sound source"), that outputs a sound that is a target, by a microphone array structured such that plural microphones are arrayed in a predetermined pattern, and forms the direction (hereinafter called "orientation direction") of the directivity of the microphone array with respect to that direction. The technique disclosed in Japanese Patent Application Laid-Open (JP-A) No. 2007-13400 is known as an example of this technique.

In the technique disclosed in JP-A No. 2007-13400, by carrying out plural different filtering processings on respective acoustic signals obtained by collecting sound by respective microphones structuring a microphone array, acoustic signals relating to plural sound collecting areas are generated from the respective plural microphones. The acoustic signals, that are generated and obtained and relate to the plural sound collecting areas, are synthesized among the plural microphones for each sound collecting area. The acoustic signal having the highest signal level is selected from among the acoustic signals per sound collecting area that were obtained by the synthesizing. It is considered that the target sound source exists in the sound collecting area corresponding to the selected acoustic signal, and the microphone array forms an orientation direction with respect to the direction of that sound collecting area.

SUMMARY

An aspect of the present invention provides a sound collecting device including: a microphone array having plural sound-collecting microphones that respectively output acoustic signals corresponding to collected sounds, the plural sound-collecting microphones being arrayed in a direction intersecting a predetermined direction such that respective orientation directions of the plural sound-collecting microphones are directed in the predetermined direction; an orientation direction forming section that forms an orientation direction of the microphone array by synthesizing acoustic signals, that are outputted from the respective sound-collecting microphones, in a state in which phase differences between, the acoustic signals corresponding to differences in arrival times at the respective sound-collecting microphones of sounds from a formed orientation direction are eliminated; and a control section that, when a frequency characteristic in a predetermined frequency band of a synthesized signal obtained by synthesizing the acoustic signals corresponds to a frequency characteristic of an acoustic signal corresponding to a sound other than a target sound, controls the orientation direction forming section such that an orientation direction that is a direction that is different than an orientation direction of the microphone array at a present point in time is formed, and, when the frequency characteristic in the predetermined frequency band of the synthesized signal does not correspond to a frequency characteristic of an acoustic signal corresponding to a sound other than the target sound, controls the orientation direction forming section such that the orientation direction of the microphone array at the present point in time is maintained.

Present invention provides a sound collecting device including: a microphone array having plural sound-collecting microphones that respectively output acoustic signals corresponding to collected sounds, the plural sound-collecting microphones being arrayed in a direction intersecting a predetermined direction such that respective orientation directions of the plural sound-collecting microphones are directed in the predetermined direction; plural orientation direction forming sections that respectively form an orientation direction of the microphone array by synthesizing acoustic signals, that are outputted from the respective sound-collecting microphones, in a state in which phase differences between the acoustic signals corresponding to differences in arrival times at the respective sound-collecting microphones of sounds from a formed orientation direction are eliminated; and a control section that, when a frequency characteristic in a predetermined frequency band of a synthesized signal obtained by synthesizing the acoustic signals by a remaining orientation direction forming section other than a specific orientation direction forming section among the plural orientation direction forming sections corresponds to a frequency characteristic of an acoustic signal corresponding to a sound other than a target sound, controls the specific orientation direction forming section such that an orientation direction that is a direction that is different than an orientation direction that is being formed by the remaining orientation direction forming section at a present point in time is formed, and, when the frequency characteristic in the predetermined frequency band of the synthesized signal obtained by the remaining orientation direction forming section does not correspond to a frequency characteristic of an acoustic signal corresponding to a sound other than the target sound, controls the specific orientation direction forming section such that an orientation direction is formed in the orientation direction that is being formed by the remaining orientation direction forming section at the present point in time.

Present invention provides an acoustic communication system that is structured to include: the sound collecting device of claim 1 having a transmitting section that transmits a synthesized signal obtained by the orientation direction forming section; and a sound output device having a receiving section that receives the synthesized signal transmitted by the transmitting section, and an outputting section that outputs a sound corresponding to the synthesized signal received by the receiving section.

Present invention provides an acoustic communication system that is structured to include: the sound collecting device of claim 2 having a transmitting section that transmits a synthesized signal obtained by the specific orientation direction forming section; and a sound output device having a receiving section that receives the synthesized signal transmitted by the transmitting section, and an outputting section that outputs a sound corresponding to the synthesized signal received by the receiving section.

Present invention provides a computer-readable storage medium storing a program for causing a computer to function as: an orientation direction forming section that forms an orientation direction of a microphone array having plural sound-collecting microphones that respectively output acoustic signals corresponding to collected sounds and in which the plural sound-collecting microphones are arrayed in a direction intersecting a predetermined direction such that respective orientation directions of the plural sound-collecting microphones are directed in the predetermined direction, by synthesizing acoustic signals outputted from the respective sound-collecting microphones of the microphone array, in a state in which phase differences between the acoustic signals corresponding to differences in arrival times at the respective sound-collecting microphones of sounds from a formed orientation direction are eliminated; and a control section that, when a frequency characteristic in a predetermined frequency band of a synthesized signal obtained by synthesizing the acoustic signals corresponds to a frequency characteristic of an acoustic signal corresponding to a sound other than a target sound, controls the orientation direction forming section such that an orientation direction that is a direction that is different than an orientation direction of the microphone array at a present point in time is formed, and, when the frequency characteristic in the predetermined frequency band of the synthesized signal does not correspond to a frequency characteristic of an acoustic signal corresponding to a sound other than the target sound, controls the orientation direction forming section such that the orientation direction of the microphone array at the present point in time is maintained.

Present invention provides a computer-readable storage medium storing a program for causing a computer to function as: plural orientation direction forming sections that respectively form an orientation direction of a microphone array having plural sound-collecting microphones that respectively output acoustic signals corresponding to collected sounds and in which the plural sound-collecting microphones are arrayed in a direction intersecting a predetermined direction such that respective orientation directions of the plural sound-collecting microphones are directed in the predetermined direction, by synthesizing acoustic signals outputted from the respective sound-collecting microphones of the microphone array, in a state in which phase differences between the acoustic signals corresponding to differences in arrival times at the respective sound-collecting microphones of sounds from a formed orientation direction are eliminated; and a control section that, when a frequency characteristic in a predetermined frequency band of a synthesized signal obtained by synthesizing the acoustic signals by a remaining orientation direction forming section other than a specific orientation direction forming section among the plural orientation direction forming sections corresponds to a frequency characteristic of an acoustic signal corresponding to a sound other than a target sound, controls the specific orientation direction forming section such that an orientation direction that is a direction that is different than an orientation direction that is being formed by the remaining orientation direction forming section at a present point in time is formed, and, when the frequency characteristic in the predetermined frequency band of the synthesized signal obtained by the remaining orientation direction forming section does not correspond to a frequency characteristic of an acoustic signal corresponding to a sound other than the target sound, controls the specific orientation direction forming section such that an orientation direction is formed in the orientation direction that is being formed by the remaining orientation direction forming section at the present point in time.

BRIEF DESCRIPTION OF THE DRAWINGS

Exemplary embodiments of the present invention will be described in detail based on the following figures, wherein:

FIG. 2 is a schematic drawing showing an example of a delay time database relating to the first through fourth exemplary embodiments;

FIG. 4 is a schematic drawing showing an example of a noise characteristic database relating to the first exemplary embodiment;

FIG. 8 is a schematic drawing showing an example of a noise characteristic database relating to the second exemplary embodiment;

FIG. 15 is a schematic drawing showing a modified example of a noise characteristic database that is used at a computer relating to the second exemplary embodiment;

DETAILED DESCRIPTION

Exemplary embodiments of the present invention are described in detail hereinafter with reference to the drawings. Note that, in the following description, explanation is given of cases in which the present invention is applied to a sound input/output device.

First Exemplary Embodiment

Figure 1:
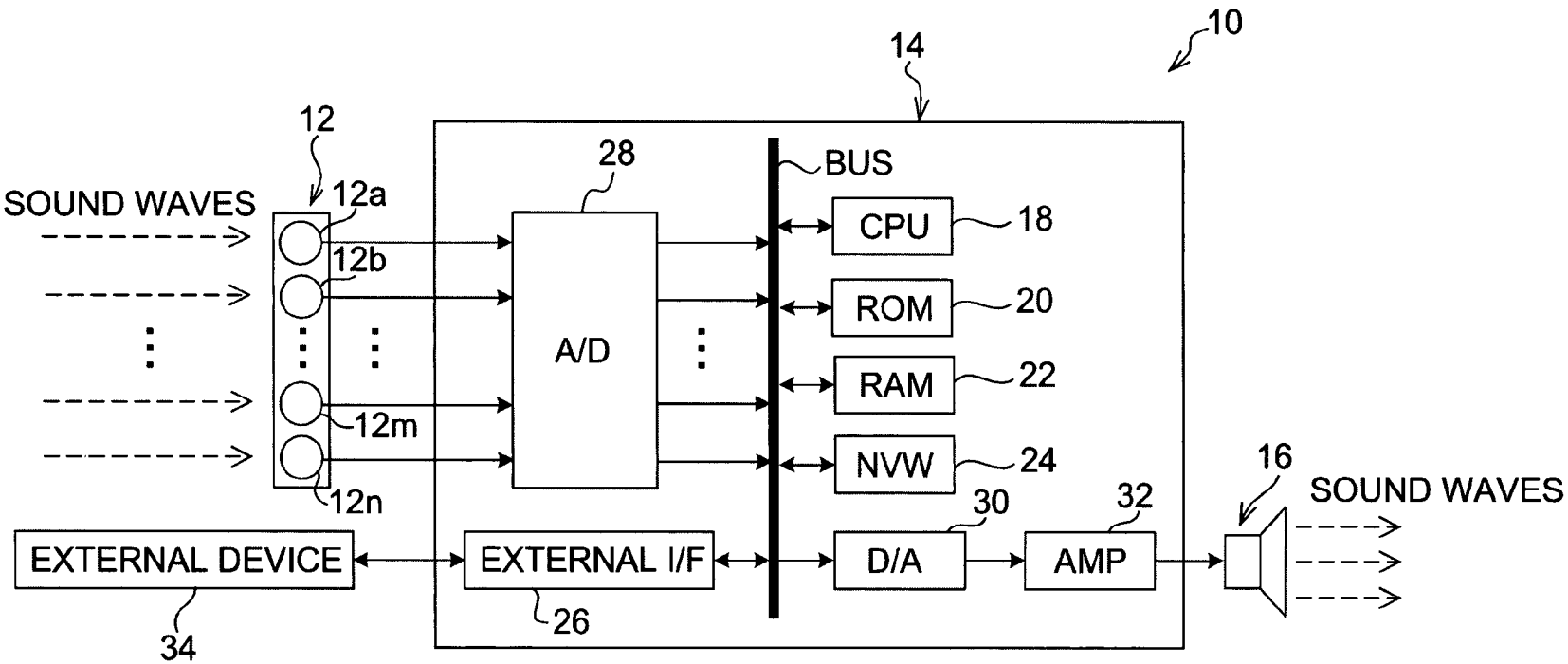
FIG. 1 is a structural drawing showing the structure of a sound input/output device relating to first through third exemplary embodiments.

The structure of a sound input/output device 10 relating to the present first exemplary embodiment is shown in FIG. 1. As shown in FIG. 1, the sound input/output device 10 has a microphone array 12, a computer 14, and a speaker 16. Note that, in the present first exemplary embodiment, the microphone array 12 and the computer 14 function as a sound collecting device that collects sound by detecting sound waves outputted from a target sound source.

The microphone array 12 is structured such that microphones 12*a* through 12*n*, that convert sounds respectively collected thereby into analog acoustic signals (hereinafter also called "analog signals") and output the analog signals, are arrayed in a rectilinear form. Note that the microphone array 12 relating to the present first exemplary embodiment collects sound with the object thereof being a predetermined range in front of the microphone array 12. Specifically, the microphone array 12 collects sound with the object thereof being the directions from greater than or equal to 45° to less than or equal to 135° with respect to the direction in which the microphones 12*a* through 12*n* are arrayed. However, the microphone array 12 is not limited to the same, and may collect sound with the object thereof being a range that is determined in accordance with the application of the sound input/output device 10, the assumed range of movement of the target sound source, or the like.

The computer 14 is structured to include a CPU (Central Processing Unit) 18, a ROM (Read Only Memory) 20, a RAM (Random Access Memory) 22, an NVM (Non Volatile Memory) 24, an external interface 26, an A/D converter 28, a D/A converter 30, and an amplifier 32.

The CPU 18 governs the overall operations of the sound input/output device 10. The ROM 20 is a storage medium in which are stored in advance a control program that controls the operation of the sound input/output device 10, and a delay time database, an orientation direction following processing program and an orientation direction correcting processing program that will be described later, and various types of parameters, and the like. The RAM 22 is a storage medium that is used as a work area or the like at the time of executing the respective types of programs. The NVM 24 is a non-volatile storage medium that stores various types of information that must be retained even if the power source switch of the device is turned off. A noise characteristic database, that will be described later, is stored in advance in the NVM 24.

The external interface 26 is connected to an external device 34 such as a personal computer or the like. The external interface 26 is for receiving various types of information (e.g., an instruction signal instructing the stopping of operation of the computer 14) from the external device 34, and for transmitting various types of information (e.g., a signal expressing the operating state of at least one of the microphone array 12 and the speaker 16) to the external device 34.

Input terminals of the A/D converter 28 are connected to the output terminals of the microphones 12*a* through 12*n*. The A/D converter 28 is for converting the analog signals, that are obtained by sound collection by the respective microphones 12*a* through 12*n*, into digital acoustic signals (hereinafter also called "digital signals"), and outputting the digital signals. The D/A converter 30 is for converting the digital signals into analog signals and outputting the analog signals. The input terminal of the amplifier 32 is connected to the output terminal of the D/A converter 30. The amplifier 32 is for amplifying, at a predetermined amplification factor, the analog signals inputted from the D/A converter 30, and outputting the amplified analog signals.

The CPU 18, the ROM 20, the RAM 22, the NVM 24, the external interface 26, the A/D converter 28, and the D/A converter 30 are connected to one another via a bus BUS such as a system bus or the like. Accordingly, the CPU 18 can respectively carry out access to the ROM 20, the RAM 22 and the NVM 24, reception of various types of information from the external device 34 via the external interface 26, transmission of various types of information to the external device 34 via the external interface 26, reception of digital signals from the A/D converter 28, and transmission of digital signals to the D/A converter 30.

The input terminal of the speaker 16 is connected to the output terminal of the amplifier 32. The speaker 16 is for outputting the sounds expressed by the analog signals inputted from the amplifier 32.

At the sound input/output device 10 relating to the present first exemplary embodiment, by using the computer 14, an orientation direction of the microphone array 12 is formed by generating a synthesized signal by synthesizing the respective digital signals, that are inputted to the CPU 18 via the A/D converter 28 from the respective microphones 12*a* through 12*n*, in a state of having eliminated the phase differences (delays) between the digital signals that arise in accordance with the differences in arrival times (the distances between the microphones) when the sound waves, that come from the formed orientation direction, arrive at the microphones 12*a* through 12*n*. Note that, in the sound input/output device 10 relating to the present first exemplary embodiment, two orientation directions, that are an orientation direction formed by generating a first synthesized signal and an orientation direction formed by generating a second synthesized signal, are formed.

In the sound input/output device 10 relating to the present first exemplary embodiment, in order to generate the synthesized signal, delay times are associated with respect to the respective microphones 12*a* through 12*n*, and the digital signals, that are inputted to the CPU 18 from the respective microphones via the A/D converter 28, are delayed at the delay times corresponding to the microphones that were the sources of output thereof, and are synthesized.

An example of the structure of a delay time database that is used in the sound input/output device 10 relating to the present first exemplary embodiment, is shown in FIG. 2.

As shown in FIG. 2, the delay time database is structured by direction information and delay time information. The direction information is structured by: information expressing the direction (hereinafter called "direction A") that is inclined by angle $\alpha$ (e.g., 45°) with respect to the direction in which the microphones 12*a* through 12*n* are arrayed; information expressing the direction (hereinafter called "direction B") that is substantially perpendicular to the direction in which the microphones 12*a* through 12*n* are arrayed; and information expressing the direction (hereinafter called "direction C") that is inclined by angle γ (e.g., 135°) with respect to the direction in which the microphones 12*a* through 12*n* are arrayed.

The delay time information is structured from: information that expresses delay times $A_1$ through $A_{14}$ corresponding to the microphones 12*a* through 12*n* for forming the orientation directions of the microphones 12*a* through 12*n* in direction A; information that expresses delay times $B_1$ through $B_{14}$ corresponding to the microphones 12*a* through 12*n* for forming the orientation directions of the microphones 12*a* through 12*n* in direction B; and information that expresses delay times $C_1$ through $C_{14}$ corresponding to the microphones 12*a* through 12*n* for forming the orientation directions of the microphones 12*a* through 12*n* in direction C. The information that expresses the delay times $A_1$ through $A_{14}$ is associated with the information expressing direction A, and the information that expresses the delay times $B_1$ through $B_{14}$ is associated with the information expressing direction B, and the delay times $C_1$ through $C_{14}$ are associated with the information expressing direction C. Note that, hereinafter, when there is no need to differentiate among the respective delay times $A_1$ through $A_{14}$, they are called delay times A. When there is no need to differentiate among the respective delay times $B_1$ through $B_{14}$, they are called delay times B. When there is no need to differentiate among the respective delay times $C_1$ through $C_{14}$, they are called delay times C.

Figure 3:
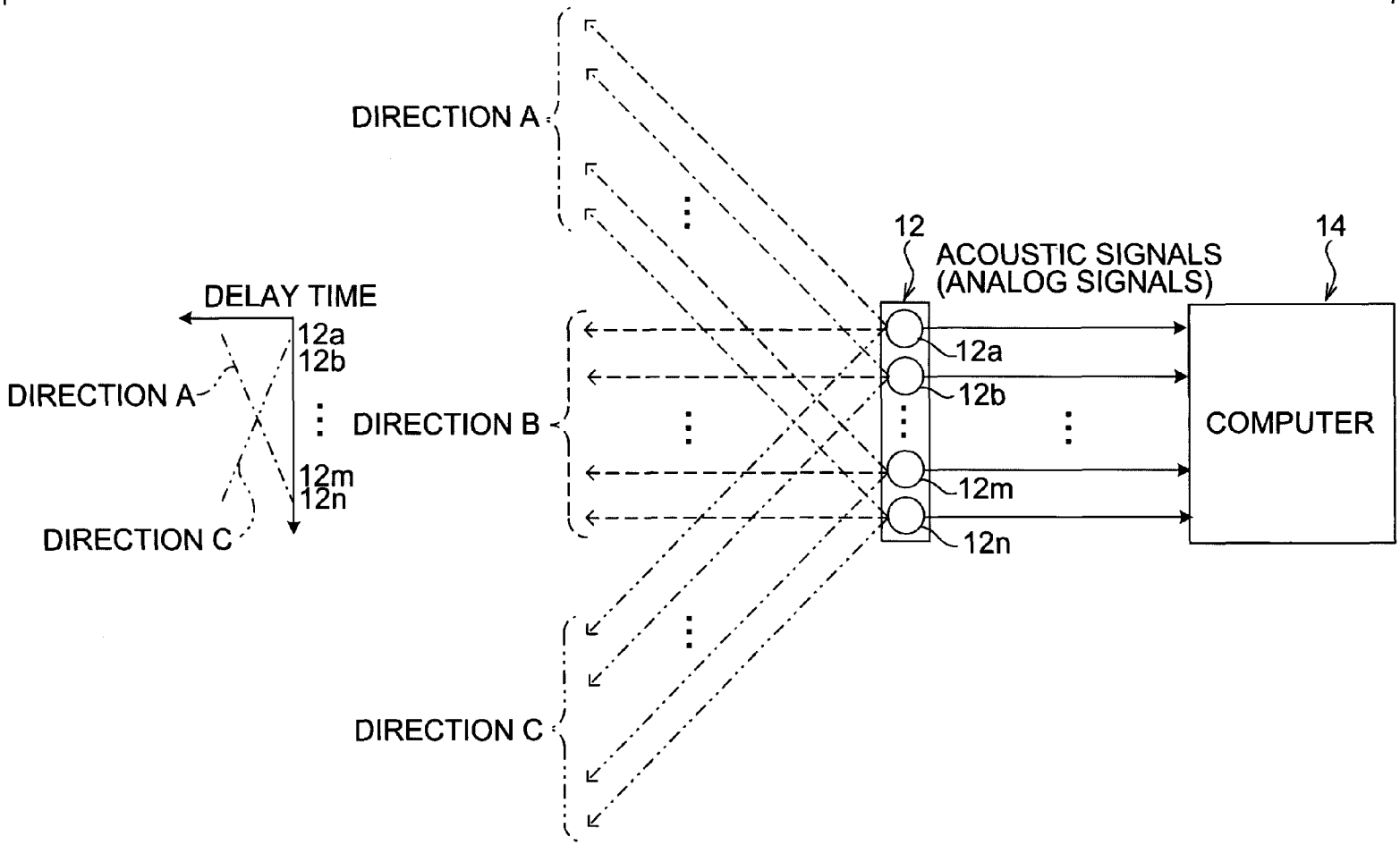
FIG. 3 is a schematic drawing showing an example of orientation directions of a microphone array relating to the first through fourth exemplary embodiments, and is a graph showing an example of relationships of correspondence between respective microphones and delay times.

FIG. 3 is a schematic drawing showing an example of the orientation directions of the microphone array 12 relating to the present first exemplary embodiment, and is a graph showing an example of the relationships of correspondence between the microphones 12*a* through 12*n* and the delay times A and C. As shown in FIG. 3, the direction of the arrows shown by the one-dot chain lines indicates direction A, the direction of the arrows shown by the dashed lines indicates direction B, and the direction of the arrows shown by the two-dot chain lines indicates direction C. The delay times $A_1$ through $A_{14}$, that are used in order to form the orientation direction of the microphone array 12 in direction A, are structured so as to become shorter at a predetermined rate successively from the microphone 12*a* toward the microphone 12*n*. Further, the delay times $C_1$ through $C_{14}$, that are used in order to form the orientation direction of the microphone array 12 in direction C, are structured so as to become longer at a predetermined rate successively from the microphone 12A toward the microphone 12*n*. Note that, in the sound input/output device 10 relating to the present first exemplary embodiment, the delay times $B_1$ through $B_{14}$ are made to be "0 seconds" in order to form the orientation direction of the microphone array 12 in direction B.

An example of the structure of a noise characteristic database that is used in the sound input/output device 10 relating to the present first exemplary embodiment, is shown in FIG. 4.

As shown in FIG. 4, the noise characteristic database is structured by the following being associated with respective noise type information that express respective types of plural, predetermined noises (sounds of large volumes that are outputted unexpectedly from sound sources other than the target sound source): a voiced sound number of times (details thereof will be described later) for each of plural, predetermined frequency bands; a priority level (comparison priority level) at the time of comparing the voiced sound numbers of times of the respective noises with the voiced sound number of times in a predetermined frequency band of the synthesized signal; an occurring number of times of the predetermined noise from a predetermined point in time (e.g., the point in time when the power source of the sound input/output device 10 is turned on) until the present; a weight value corresponding to the noise type information; and a frequency of occurrence corresponding to the results of multiplication of the occurring number of times of the noise until the present and the corresponding weight value.

Concretely, three types of noise type information that are noise A (e.g., a specific incoming sound at a specific fixed telephone), noise B (e.g., a specific incoming sound at a specific mobile telephone), and noise C (e.g., the operating sound of a specific air conditioner unit) are included as noise type information. Further, voiced sound numbers of times in four frequency bands that are 0 times corresponding to frequency band A (e.g., 700 Hz through 1000 Hz), 5 times corresponding to frequency band B (e.g., 1200 through 1500 Hz), 0 times corresponding to frequency band C (e.g., 2500 Hz through 2900 Hz), and 5 times corresponding to frequency band D (e.g., 3700 Hz through 4000 Hz) are included as the voiced sound numbers of times of noise A. Moreover, voiced sound numbers of times in four frequency bands that are 10 times corresponding to frequency band A, 0 times corresponding to frequency band B, 10 times corresponding to frequency band C, and 0 times corresponding to frequency band D, are included as the voiced sound numbers of times of noise B. Still further, voiced sound numbers of times in four frequency bands that are 20 times corresponding to frequency band A, 25 times corresponding to frequency band B, 30 times corresponding to frequency band C, and 35 times corresponding to frequency band D, are included as the voiced sound numbers of times of noise C.

In the noise characteristic database in the initial state, priority level 1 is given to noise A, priority level 2 is given to noise B, and priority level 3 is given to noise C, as the comparison priority levels.

In the noise characteristic database, as the weight values, 1.2 is stored for noise A, 1.8 is stored for noise B, and 1.5 is stored for noise C.

Further, in the noise characteristic database in the initial state, the occurring number of times and frequency of occurrence of each of noises A through C is set to "0". The occurring number of times of each of noises A through C is incremented by 1 each time the corresponding noise occurs. The frequency of occurrence of each of noises A through C also is updated each time the corresponding noise occurs. Note that the comparison priority levels are updated in accordance with the relationships of the magnitudes among the respective frequencies of occurrence. Namely, priority level 1 is given as the comparison priority level to the noise whose frequency of occurrence is greatest, priority level 2 is given as the comparison priority level to the noise having the next greatest frequency of occurrence, and priority level 3 is given as the comparison priority level to the noise having the smallest frequency of occurrence.

Note that, in the present first exemplary embodiment, the aforementioned "initial state" means the state at the time when the power source of the sound input/output device 10 is turned on, and, each time the power source is turned on, the occurring numbers of times and the frequencies of occurrence are reset to "0". However, the present invention is not limited to the same, and the occurring numbers of times and frequencies of occurrence do not have to be reset each time the power source is turned on. Further, the resetting time does not have to be limited to the time of turning the power source on. For example, resetting may be carried out when a predetermined time elapses from the turning on of the power source. Or, resetting may be carried out when at least one of the occurring number of times and the frequency of occurrence reaches a predetermined value. Further, plural conditions may be readied in advance as conditions for carrying out resetting, and at least one of these conditions may be designated by the user via the external device 34, and resetting may be carried out when the designated condition is satisfied. The time or conditions at which resetting is to be carried out in this way may be determined by taking into consideration the usage environment, the purpose of use, or the like of the sound input/output device 10.

Operation of the sound input/output device 10 relating to the present first exemplary embodiment is described next.

The computer 14 of the sound input/output device 10 relating to the present first exemplary embodiment forms the orientation direction of the microphone array 12 in direction B by synthesizing the respective digital signals inputted via the A/D converter 28 from the respective microphones 12*a* through 12*n*. The computer 14 outputs the first synthesized signal, that is obtained by synthesizing the respective digital signals, to the D/A converter 30. The D/A converter 30 converts the inputted first synthesized signal into an analog signal. The amplifier 34 amplifies this analog signal at a predetermined amplification factor, and outputs the amplified analog signal to the speaker 16. Due thereto, sounds that are expressed by the analog signals inputted from the amplifier 32, i.e., sounds that the microphone array 12 collected due to the orientation direction being formed in direction B, are outputted from the speaker 16.

In the sound input/output device 10 relating to the present first exemplary embodiment, as the target sound source moves, orientation direction following processing is executed that causes the orientation direction, that is formed by generating the first synthesized signal, to follow the direction in which the target sound source exists.

Figure 5:
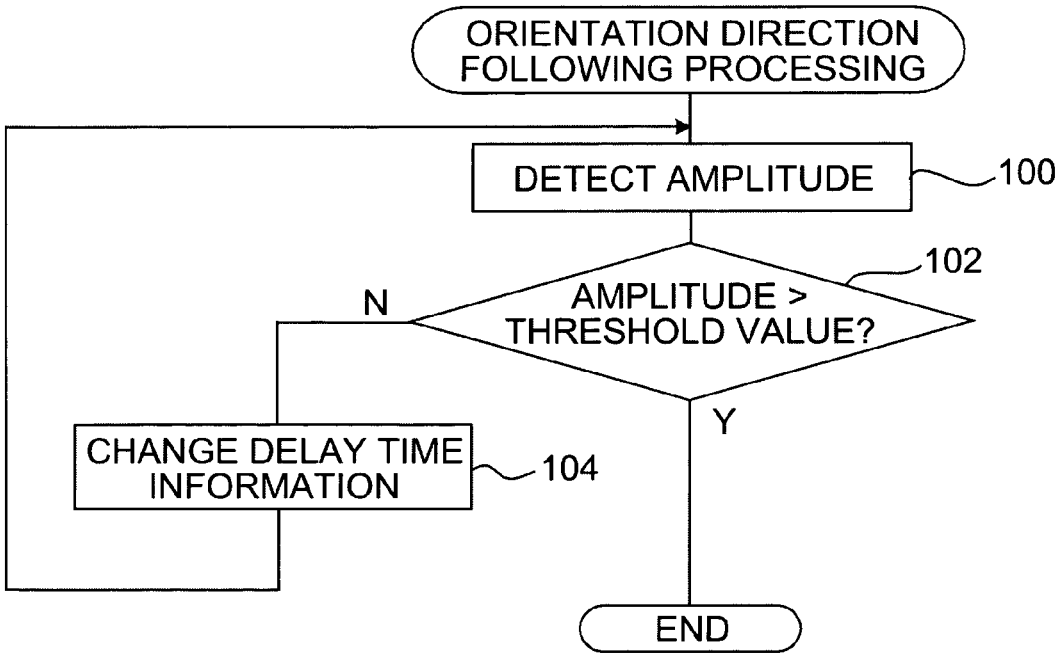
FIG. 5 is a flowchart showing the flow of processings of an orientation direction following processing program relating to the first and second exemplary embodiments.

Next, operation of the sound input/output device 10 at the time of executing orientation direction following processing will be described with reference to FIG. 5. Note that FIG. 5 is a flowchart showing the flow of processings of the orientation direction following processing program that is executed by the CPU 18 each predetermined time (e.g., 0.1 seconds) when the power source of the sound input/output device 10 is turned on. Note that, here, in order to avoid confusion, explanation is given of a case in which the orientation direction is formed by generating the first synthesized signal, and the information expressing delay times $B_1$ through $B_{14}$ is used as the delay time information that is used at the time of generating this first synthesized signal, i.e., a case in which the orientation direction is formed in direction B.

In step 100 of FIG. 5, the amplitude of the signal level (corresponding to the sound pressure) of the acoustic signal is detected. Thereafter, the routine moves on to step 102 where it is judged whether or not the amplitude detected in step 100 exceeds a predetermined threshold value (e.g., 12 dB). If the judgment is negative, the routine moves on to step 104. The delay time information, other than the delay time information that is being employed in order to generate the first synthesized signal at the present point in time, is acquired from the delay time database, and the first synthesized signal is generated on the basis of the delay times expressed by the acquired delay time information. Thereafter, the routine returns to step 100. Note that, in the orientation direction following processing relating to the present first exemplary embodiment, the delay time information, that is employed in order to generate the first synthesized signal, is changed by repeatedly employing information in the order of the information expressing delay times B→ the information expressing delay times C→ the information expressing delay times A→ the information expressing delay times B . . . , starting from the time of the start of turning on of the power source. For example, in above step 104, if, at the stage when execution of the processing starts, the first synthesized signal is being generated by the information expressing the delay times B, the information expressing the delay times C is acquired.

On the other hand, if the judgment in step 102 is affirmative, the present orientation direction following processing program ends.

However, if noise is outputted from a noise source existing in the orientation direction that is formed by generating the first synthesized signal at the present point in time, that noise is outputted from the speaker 16.

Thus, in the sound input/output device 10 relating to the present first exemplary embodiment, orientation direction correcting processing, that corrects the orientation direction formed by generating the first synthesized signal, is executed so as to suppress formation of the orientation direction in a direction in which a noise source exists.

Operation of the sound input/output device 10 at the time when the orientation direction correcting processing is executed is described next with reference to FIG. 6. Note that FIG. 6 is a flowchart showing the flow of processings of an orientation direction correcting processing program that is executed by the CPU 18 each predetermined time (e.g., 0.5 sec) when the power source of the sound input/output device 10 is turned on.

Figure 6:
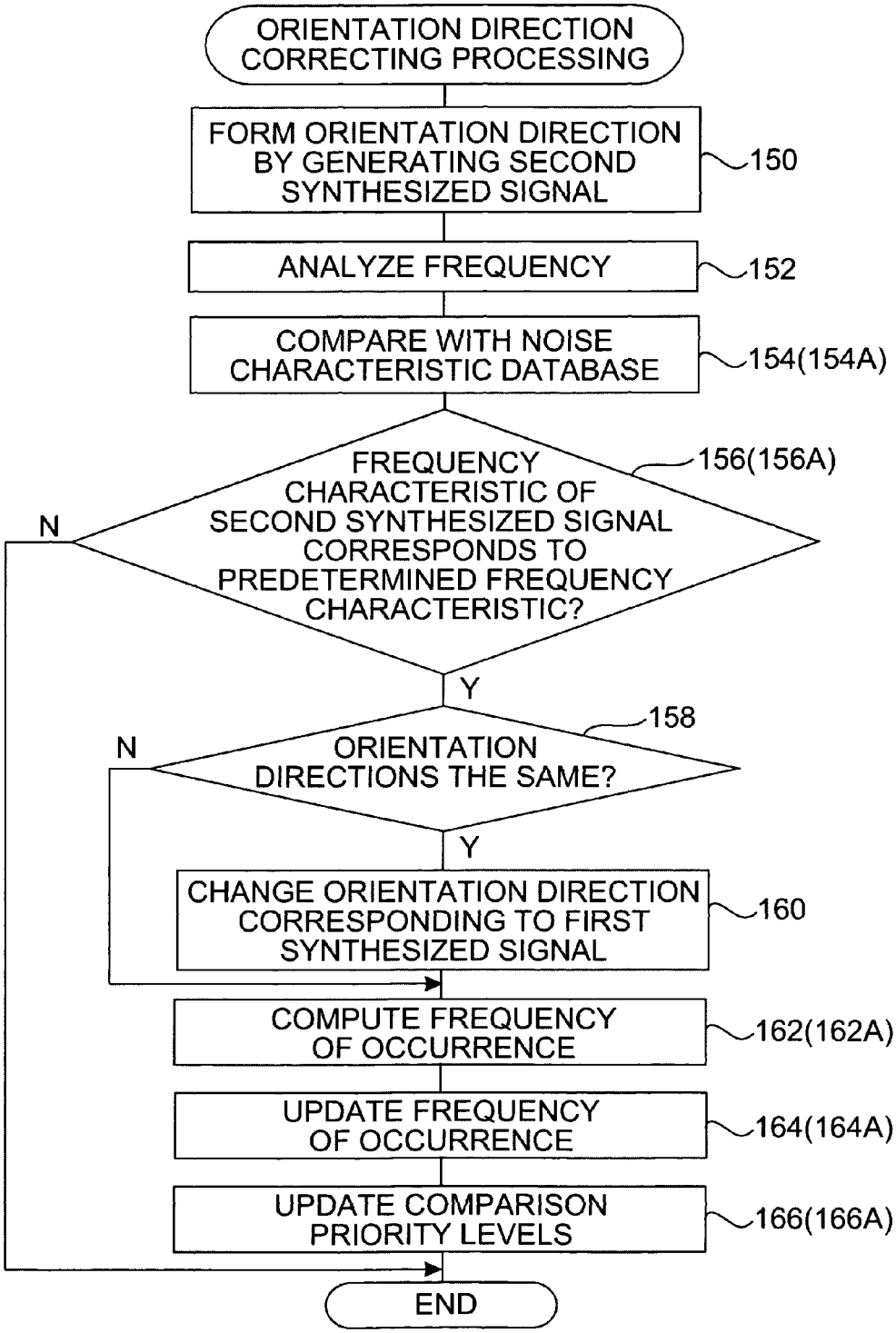
FIG. 6 is a flowchart showing the flow of processings of an orientation direction correcting processing program relating to the first and second exemplary embodiments.

In step 150 of FIG. 6, delay time information is acquired from the delay time database, and the orientation direction is formed by generating the second synthesized signal on the basis of the delay times expressed by the acquired delay time information. Note that, in the orientation direction correcting processing relating to the present first exemplary embodiment, the delay time information that is employed in order to generate the second synthesized signal is changed by repeatedly employing information in the order of the information expressing delay times A→ the information expressing delay times B→ the information expressing delay times C→ the information expressing delay times A . . . , starting from the time of the start of turning on of the power source.

Figure 7A:
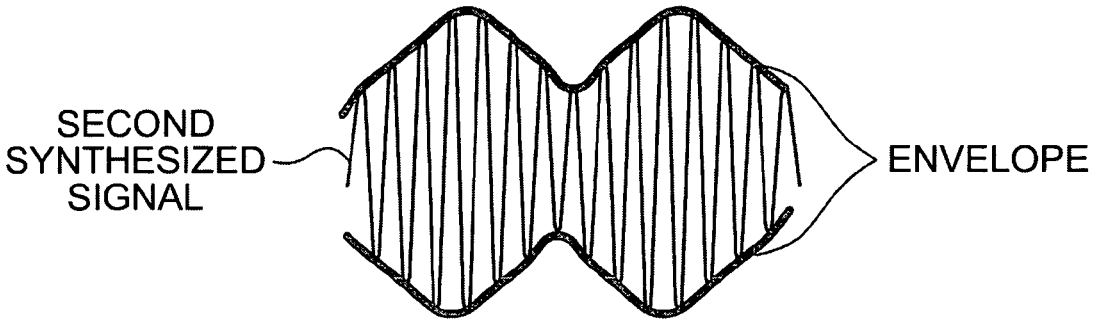
FIG. 7A is a drawing for explaining frequency analysis processing that is executed by a computer relating to the first through fourth exemplary embodiments, and is a schematic drawing for explaining a method of forming an envelope.
Figure 7B:
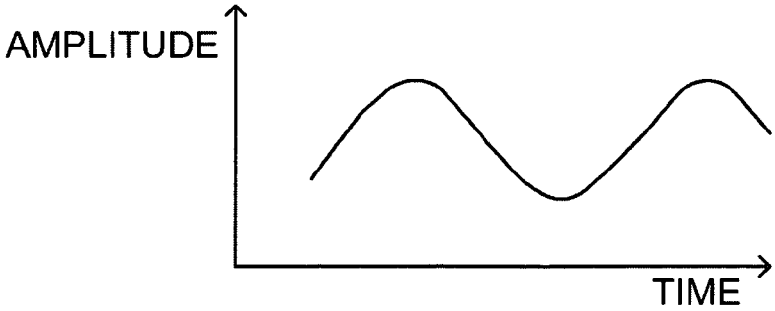
FIG. 7B is a drawing for explaining frequency analysis processing that is executed by a computer relating to the first through fourth exemplary embodiments, and is a graph showing an example of a time-amplitude characteristic that is derived on the basis of the envelope.

In next step 152, frequency analysis of the second synthesized signal, that was obtained by executing the processing of step 150, is carried out. Specifically, as shown in FIG. 7A as an example, by carrying out a Hilbert transform or the like on the second synthesized signal, the envelope that expresses the external shape that connects the peaks of the amplitude of the second synthesized signal that is oscillating is extracted as an envelope, and, as shown in FIG. 7B as an example, information expressing the fluctuation characteristic of the amplitude, with respect to the time axis, of the envelope is made into a database and derived.

In next step 154, on the basis of the results of the frequency analysis of step 152, the voiced sound numbers of times (frequency characteristics) in a predetermined frequency band of acoustic signals that correspond to predetermined noises that are shown by the noise characteristic database, and the voiced sound number of times in the predetermined frequency band of the second synthesized signal obtained by executing the processing of step 150, are compared. Note that "voiced sound number of times" in the present first exemplary embodiment means the number of times that the amplitude shown in FIG. 7B exceeds a predetermined threshold value. In the present first exemplary embodiment, a case in which the signal level of the second synthesized signal shows a volume of greater than or equal to 12 dB is considered to be a voiced sound state, and a case in which the signal level of the second synthesized signal shows a volume of less than 12 dB is considered to be a silent state.

In next step 156, at each of the frequency bands A through D within a predetermined time (e.g., 0.3 seconds), it is judged whether or not the voiced sound number of times, that is based on the second synthesized signal obtained by executing the processing of step 150, and the voiced sound number of times of any of noises A through C in the noise characteristic database, coincide. If the judgment is negative, the present orientation direction correcting processing program ends without the processings of steps 158 through 166 being executed. On the other hand, if the judgment is affirmative, the routine moves on to step 158. For example, when a specific fixed telephone outputs an incoming sound in which a voiced sound state and a silent state alternately switch at frequencies of 1250 Hz, 1650 Hz, 3080 Hz, 3900 Hz, 4160 Hz, and 5560 Hz, the second synthesized signal shows a voiced sound state five times in each of frequency band B and frequency band D within the predetermined time. Therefore, in step 156, it is judged that the sound expressed by the second synthesized signal corresponds to noise A in the noise characteristic database.

In step 158, it is judged whether or not the orientation direction that is being formed by generating the first synthesized signal at the present point in time and the orientation direction that is being formed by generating the second synthesized signal are the same. Namely, it is judged whether or not the first and second synthesized signals at the present point in time are generated on the basis of the same delay time information. If the judgment is affirmative, the routine moves on to step 160. If the judgment is negative, the routine moves on to step 162 without the processing of step 160 being carried out.

In step 160, the delay time information, other than the delay time information that is being employed in order to generate the first synthesized signal at the present point in time, is acquired from the delay time database, and the orientation direction is formed by generating the first synthesized signal on the basis of the delay times expressed by the acquired delay time information. Due thereto, for example, if the acquired delay time information is information expressing the delay times C, due to the first synthesized signal being generated, the orientation direction of the microphone array 12 is formed so as to be directed toward direction C as shown in FIG. 3. Therefore, the sound collected by the microphone array 12, with the object thereof being the sound collecting region of direction C shown in FIG. 3, is outputted from the speaker 16.

In next step 162, the occurring number of times, that corresponds to the noise that was judged in above step 156 to have a voiced sound number of times that coincides with the voiced sound number of times of the second synthesized signal, is incremented by 1. Thereafter, the occurring number of times at the present point in time and the weight value, that corresponds to the noise that was judged in above step 156 to have a voiced sound number of times that coincides with the voiced sound number of times of the second synthesized signal, are multiplied. Thereafter, the routine moves on to step 164, and the frequency of occurrence, that corresponds to the noise that was judged in above step 156 to have a voiced sound number of times that coincides with the voiced sound number of times of the second synthesized signal, is updated by being replaced by the results of multiplication obtained by the multiplication in the processing of above step 162.

In next step 166, the comparison priority levels given to the noises A through C respectively are updated by being changed such that, at the present point in time, the comparison priority level of the noise whose frequency of occurrence is the greatest becomes priority level 1, the comparison priority level of the noise having the next largest frequency of occurrence becomes priority level 2, and the comparison priority level of the noise having the smallest frequency of occurrence becomes priority level 3. Thereafter, the present orientation direction correcting processing program ends.

Note that, in the flowcharts shown in FIG. 5 and FIG. 6, the respective processings of steps 104, 150 correspond to the orientation direction forming section of the present invention, step 160 corresponds to the control section of the present invention, and steps 162, 164 correspond to the associating section of the present invention.

As described in detail above, in the sound input/output device 10 relating to the present first exemplary embodiment, in frequency bands A through D, when the frequency characteristic of the second synthesized signal coincides with any of the frequency characteristics corresponding to plural acoustic signals respectively corresponding to noises A through C that serve as sounds other than the target sound, the directivity formed by generating the first synthesized signal is formed in a direction that is different than the orientation direction that is being formed by generating the second synthesized signal at the present point in time. In frequency bands A through D, when the frequency characteristic of the second synthesized signal does not coincide with any of the frequency characteristics respectively corresponding to noises A through C, the directivity formed by generating the first synthesized signal is formed in the orientation direction that is being formed by generating the second synthesized signal at the present point in time. Therefore, it is possible to suppress the formation of the orientation direction in a direction in which a noise source exists, and the orientation direction formed by the first synthesized signal being generated can be formed so as to follow the movement of the target sound source.

Further, in the sound input/output device 10 relating to the present first exemplary embodiment, the frequency of occurrence of each of noises A through C is computed, and the frequencies of occurrence obtained by computation are associated with the corresponding noises, and the comparison priority levels are changed such that the frequency characteristics respectively corresponding to the noises A through C are compared with the frequency characteristic of the second synthesized signal in order from the sound whose frequency of occurrence is largest among noises A through C. Therefore, comparison priority levels corresponding to the actual frequencies of occurrence are given to noises A through C respectively, and comparison of the frequency characteristics can be carried out even more efficiently.

Second Exemplary Embodiment

The above first exemplary embodiment describes, as an example, a case in which the comparison priority levels given to noises A through C respectively are changed without differentiating among the orientation directions formed by generating the second synthesized signal. However, the present second exemplary embodiment describes an example in which the comparison priority levels given to noises A through C respectively are changed per orientation direction that is formed by generating the second synthesized signal. Note that, in the present second exemplary embodiment, portions that are the same as those of the first exemplary embodiment are denoted by the same reference numerals, and description thereof is omitted. Further, in the present second exemplary embodiment, points that differ from the first exemplary embodiment will be described.

An example of a noise characteristic database relating to the present second exemplary embodiment is shown schematically in FIG. 8. As shown in FIG. 8, the noise characteristic database relating to the present second exemplary embodiment differs from the noise characteristic database, that is shown in FIG. 4 and was described in the above first exemplary embodiment, with regard to the point that each of the noise type information described in the first exemplary embodiment is respectively divided into information expressing direction A (hereinafter called "direction information A"), information expressing direction B (hereinafter called "direction information B"), and information expressing direction C (hereinafter called "direction information C"), and a voiced sound number of times, a comparison priority level, an occurring number of times, a weight value, and a frequency of occurrence, that were described in the first exemplary embodiment, are associated with each direction information of each noise type information. Further, the point that comparison priority levels are given to each direction among the noise type information also differs from the noise characteristic database shown in FIG. 4.

Operation at the time of executing the orientation direction correcting processing relating to the present second exemplary embodiment is described next with reference to FIG. 6. FIG. 6 is a flowchart showing the flow of processings of the orientation direction correcting processing program relating to the present second exemplary embodiment. The flowchart showing the flow of processings of the orientation direction correcting processing program relating to the present second exemplary embodiment differs from the flowchart showing the flow of processings of the orientation direction correcting processing relating to the above first exemplary embodiment with regard to the points that processing of step 154A is applied instead of the processing of step 154, processing of step 156A is applied instead of the processing of step 156, processing of step 162A is applied instead of the processing of step 162, processing of step 164A is applied instead of the processing of step 164, and processing of step 166A is applied instead of the processing of step 166. Therefore, in the flowchart shown in FIG. 6, steps carrying out the same processings as in the flowchart showing the flow of processings of the orientation direction correcting processing program relating to the above first exemplary embodiment are denoted by the same step numbers, and description thereof is omitted. The points that differ from the flowchart showing the flow of processings of the orientation direction correcting processing program relating to the above first exemplary embodiment are described.

In step 154A of FIG. 6, on the basis of the results of frequency analysis in above step 152, the voiced sound numbers of times of noises A through C in the noise characteristic database shown in FIG. 8 are compared with the voiced sound number of times of the second synthesized signal obtained by executing the processing of above step 152, in accordance with the comparison priority levels given to the direction information showing the orientation direction of the microphone array 12 that was formed by generating the second synthesized signal in step 150.

In next step 156A, at each of the frequency bands A through D within a predetermined time, it is judged whether or not the voiced sound number of times in a predetermined frequency band of the second synthesized signal obtained by executing the processing of step 150, and any of the voiced sound numbers of times that are associated with the direction information showing the orientation direction of the microphone array 12 formed by generating the second synthesized signal in above step 150 of noises A through C in the sound characteristic database shown in FIG. 8, coincide. If the judgment is negative, the present orientation direction correcting processing program ends without the processings of steps 158 through 166A being executed. On the other hand, if the judgment is affirmative, the routine moves on to step 158.

When execution of the processing of step 160 ends, the routine moves on to step 162A, and the occurring number of times, that corresponds to the direction information expressing the orientation direction of the microphone array 12 formed by generating the second synthesized signal in above step 150 of the noise that was judged in above step 156A to have a voiced sound number of times that coincides with the voiced sound number of times of the second synthesized signal, is incremented by 1. Thereafter, the occurring number of times at the present point in time and the weight value, that corresponds to the direction information expressing the orientation direction of the microphone array 12 formed by generating the second synthesized signal in above step 150 of the noise that was judged in above step 156A to have a voiced sound number of times that coincides with the voiced sound number of times of the second synthesized signal, are multiplied. Thereafter, the routine moves on to step 164A, and the frequency of occurrence, that corresponds to the direction information expressing the orientation direction of the microphone array 12 formed by generating the second synthesized signal in above step 150 of the noise that was judged in above step 156A to have a voiced sound number of times that coincides with the voiced sound number of times of the second synthesized signal, is updated by being replaced by the results of multiplication obtained by the multiplication in the processing of above step 162A.

In next step 166A, the comparison priority levels given to the respective orientation information A through C of the respective noises A through C are updated by changing the comparison priority levels given respectively to the direction information A through C, with respect to each of the noises A through C such that, for each direction information, the comparison priority level of the noise whose frequency of occurrence is the greatest becomes priority level 1, the comparison priority level of the noise having the next largest frequency of occurrence becomes priority level 2, and the comparison priority level of the noise having the smallest frequency of occurrence becomes priority level 3. Thereafter, the present orientation direction correcting processing program ends.

As described above in detail, in the sound input/output device 10 relating to the present second exemplary embodiment, the frequency of occurrence of each of noises A through C is computed for each of directions A through C. The frequencies of occurrence that are obtained by computation are associated with the noises corresponding to those frequencies of occurrence of the orientation directions corresponding to those frequencies of occurrence. The comparison priority levels are changed per orientation direction. By comparing the frequency characteristics corresponding to noises A through C respectively with the frequency characteristic of the second synthesized signal at each of the frequency bands A through D in accordance with the comparison priority levels corresponding to the orientation direction that is being formed by generating the second synthesized signal at the present point in time, comparison priority levels, that correspond to the actual frequencies of occurrence per orientation direction, are given to the respective noises A through C. Therefore, comparison of the frequency characteristics can be carried out even more efficiently.

Third Exemplary Embodiment

The above first and second exemplary embodiments describe examples of cases using the second synthesized signal. However, the present third exemplary embodiment describes, as an example, a case in which the second synthesized signal is not used. Note that, because the structure of the sound input/output device 10 relating to the present third exemplary embodiment is the same as the structure of the sound input/output device 10 relating to the above first exemplary embodiment, portions that are the same as those of the first exemplary embodiment are denoted by the same reference numerals, and description thereof is omitted. Hereinafter, the operation of the sound input/output device 10 at the time of executing sound input/output processing relating to the present third exemplary embodiment will be described with reference to FIG. 9.

Figure 9:
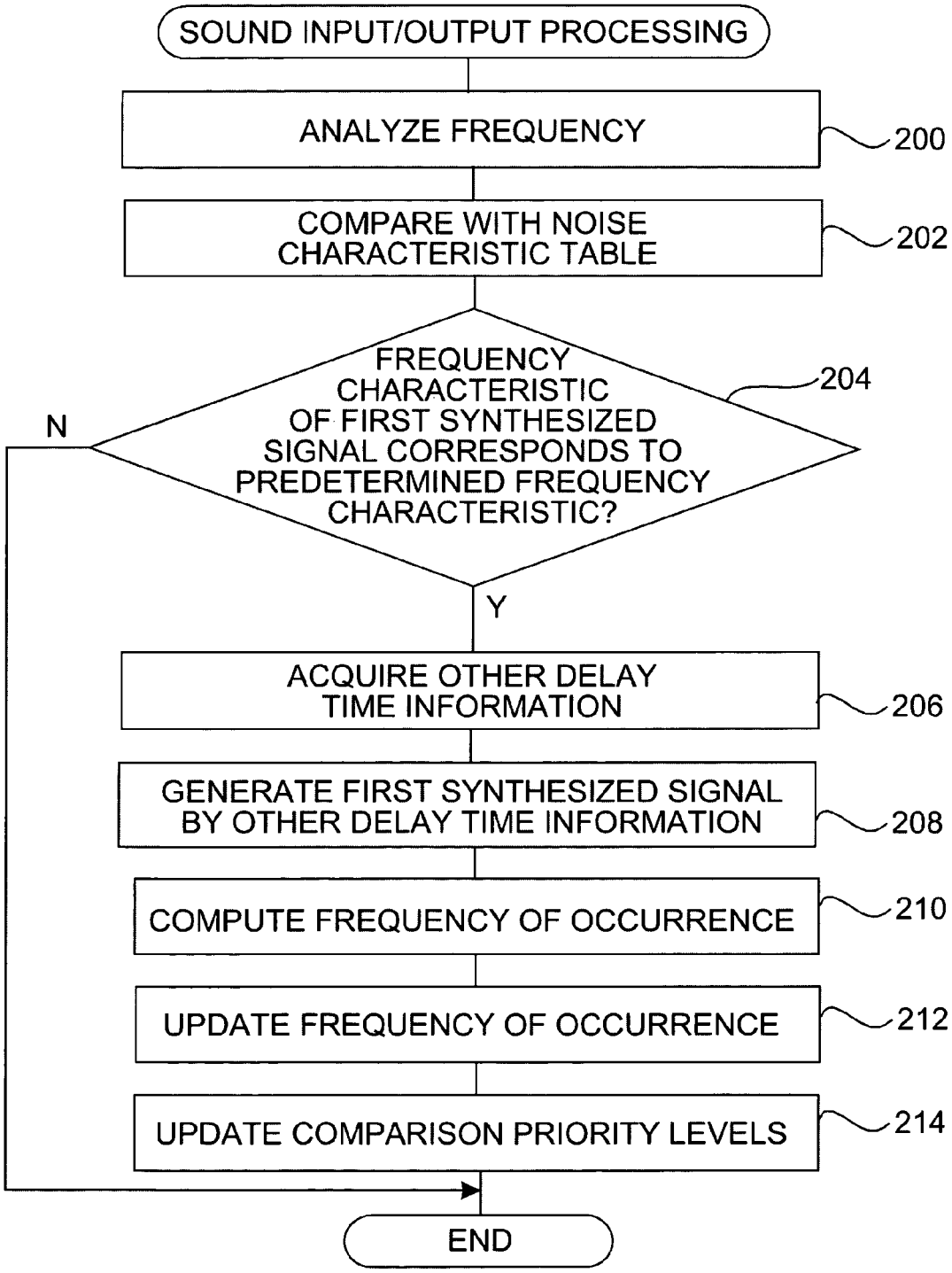
FIG. 9 is a flowchart showing the flow of processings of a sound input/output program relating to the third exemplary embodiment.

FIG. 9 is a flowchart showing the flow of processings of a sound input/output processing program relating to the present third exemplary embodiment that is executed each predetermined time (e.g., 1 second) by the CPU 18 when the power source of the sound input/output device 10 is turned on. Further, here, in order to avoid confusion, description will be given of a case in which the orientation direction of the microphone array 12 is formed in direction B shown in FIG. 3 by generating the first synthesized signal by synthesizing the respective digital signals inputted via the A/D converter 28 from the respective microphones 12*a* through 12*n*.

In step 200 of FIG. 9, frequency analysis of the first synthesized signal is carried out. Thereafter, the routine moves on to step 202, and, on the basis of the results of the frequency analysis in step 200, the voiced sound numbers of times of noises A through C in the noise characteristic database shown in FIG. 4 and the voiced sound number of times that is based on the first synthesized signal are compared.

In next step 204, for each of the frequency bands A through D within a predetermined time (e.g., 0.3 seconds), it is judged whether or not the voiced sound number of times of the first synthesized signal and the voiced sound number of times of any of noises A through C in the noise characteristic database coincide. If the judgment is negative, the present sound input/output processing program ends without the processings of steps 206 through 214 being executed. On the other hand, if the judgment is affirmative, the routine moves on to step 206.

In step 206, the delay time information, other than the delay time information that is being employed in order to generate the first synthesized signal at the present point in time, is acquired from the delay time database. Note that, in the present third exemplary embodiment, the delay time information that is employed in order to generate the first synthesized signal is repeatedly employed in the order of the information expressing delay times B→ the information expressing delay times C→ the information expressing delay times A→ the information expressing delay times B . . . , starting from the time of the start of turning on of the power source. For example, in above step 206, if, at the stage when execution of the processing starts, the first synthesized signal is being generated by the information expressing the delay times B, the information expressing the delay times C is acquired.

In next step 208, the first synthesized signal is generated on the basis of the delay time information acquired in above step 206, and the generated first synthesized signal is outputted to the D/A converter 30. Due thereto, when the delay time information acquired in above step 206 is information expressing the delay times C for example, by generating the first synthesized signal in above step 208, the orientation direction of the microphone array 12 is formed so as to be directed toward direction C shown in FIG. 3. Therefore, the sounds that are collected by the microphone array 12, with the sound collecting region of direction C shown in FIG. 3 being the object thereof, are outputted from the speaker 16.

In next step 210, the occurring number of times, that corresponds to the noise that was judged in above step 204 to have a voiced sound number of times that coincides with the voiced sound number of times of the first synthesized signal, is incremented by 1. Thereafter, the value of the occurring number of times at the present point in time and the weight value, that corresponds to the noise that was judged in above step 204 to have a frequency characteristic coinciding with the frequency characteristic of the second synthesized signal, are multiplied. Thereafter, the routine moves on to step 212, and the frequency of occurrence, that corresponds to the noise that was judged in above step 204 to have a voiced sound number of times that coincides with the voiced sound number of times of the first synthesized signal, is updated by being replaced by the results of multiplication obtained by the multiplication in the processing of above step 210.

In next step 214, the comparison priority levels given to the noises A through C respectively are updated by being changed such that, at the present point in time, the comparison priority level of the noise whose frequency of occurrence is the greatest becomes priority level 1, the comparison priority level of the noise having the next largest frequency of occurrence becomes priority level 2, and the comparison priority level of the noise having the smallest frequency of occurrence becomes priority level 3. Thereafter, the present sound input/output processing program ends.

As described in detail above, in the sound input/output device 10 relating to the present third exemplary embodiment, at each of the frequency bands A through D, if the frequency characteristic of the first synthesized signal coincides with any of the frequency characteristics of noises A through C, the orientation direction of the microphone array 12 is switched to another direction. At each of the frequency bands A through D, if the frequency characteristic of the first synthesized signal does not coincide with any of the frequency characteristics of the noises A through C, the orientation direction of the microphone array 12 at the present point in time is maintained. Therefore, formation of the orientation direction in a direction in which a noise source exists can be suppressed.

Fourth Exemplary Embodiment

Although the sound input/output device 10 is described as an example in the above first through third exemplary embodiments, an acoustic communication system is described as an example in the present fourth exemplary embodiment. Note that, in the present fourth exemplary embodiment, portions that are the same as those of the first exemplary embodiment are denoted by the same reference numerals, and description thereof is omitted.

Figure 10:
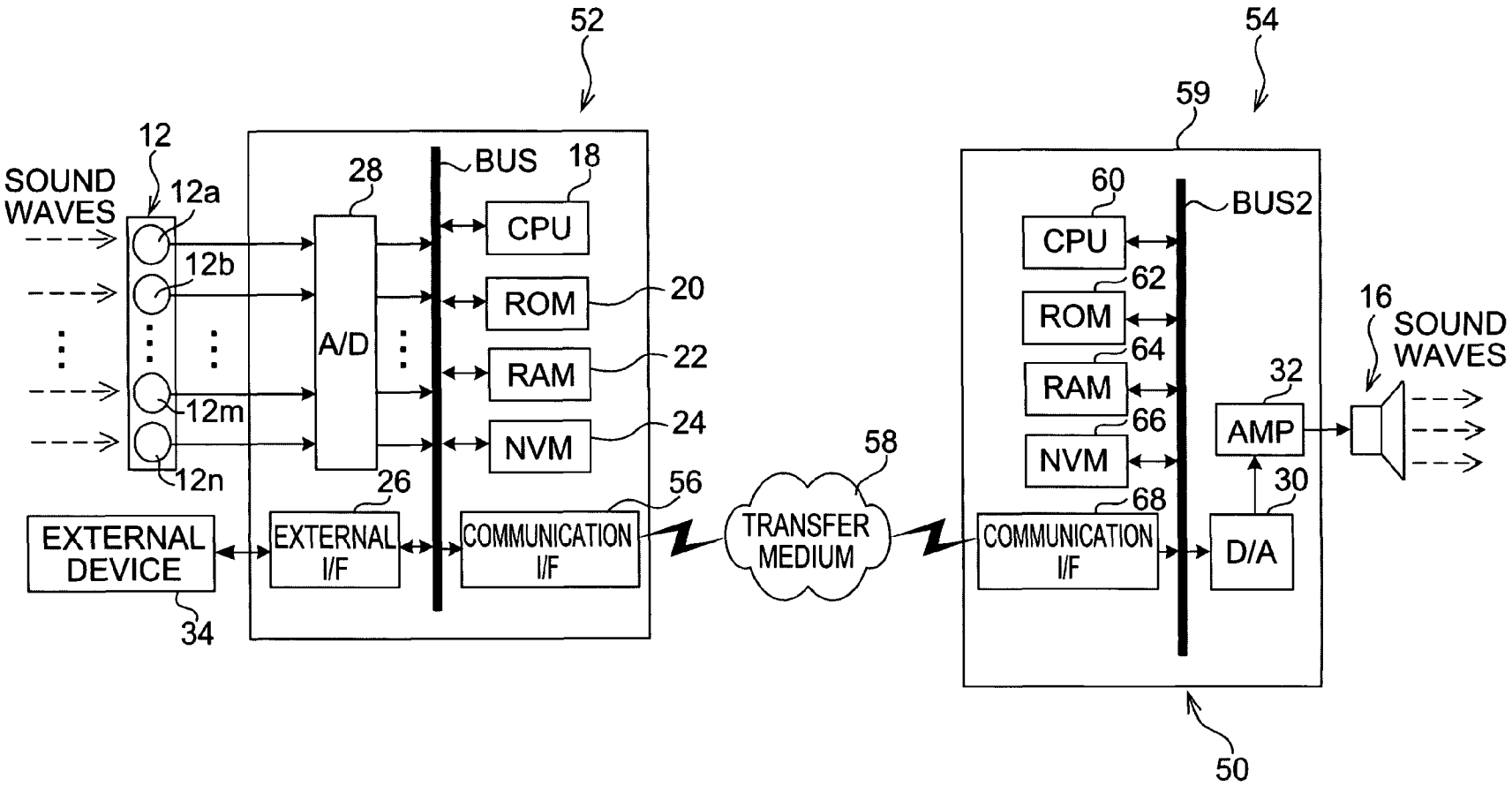
FIG. 10 is a structural drawing showing the structure of an acoustic communication system relating to the fourth exemplary embodiment.

The structure of an acoustic communication system 50 relating to the present fourth exemplary embodiment is shown in FIG. 10. As shown in FIG. 10, the acoustic communication system 50 has a sound collecting device 52 and a sound output device 54. The sound collecting device 52 differs from the sound input/output device 10 of the above first exemplary embodiment with regard to the point that the D/A converter 30 and the amplifier 32 are omitted, and the point that a communication interface 56 is newly provided.

The communication interface 56 is connected to a transfer medium 58, and is for receiving various types of information (e.g., information expressing the operation status of the sound output device 54) via the transfer medium 58 from the sound output device 54 or a terminal device such as a personal computer or the like, and for transmitting various types of information (e.g., the first synthesized signal) via the transfer medium 58 to the sound input/output device 54 or a personal computer or the like. Note that, in the present fourth exemplary embodiment, a modem (modulator and demodulator) is used as the communication interface 56. Further, the acoustic communication system 50 relating to the present fourth exemplary embodiment uses the interne as the transfer medium 58, but is not limited to the same, and any of various types of networks such as a LAN (Local Area Network), a VAN (Value Added Network), a telephone line network, an ECHONET, a Home PNA or the like can be used singly or in combination. Further, the transfer medium 58 may be wired or may be wireless.

The communication interface 56 is connected to the bus BUS. Accordingly, the CPU 18 can respectively carry out receipt of various types of information from the sound output device 54 via the communication interface 56, and transmission of various types of information to the sound output device 54 via the communication interface 56.

The sound output device 54 has the speaker 16 and a computer 59. The computer 59 is structured to include a CPU 60, a ROM 62, a RAM 64, an NVM 66, the D/A converter 30, the amplifier 32, and a communication interface 68.

The CPU 60 governs the overall operations of the sound collecting device 52. The ROM 62 is a storage medium in which are stored in advance a control program that controls the operation of the sound output device 54, a sound outputting processing program that will be described later, various types of parameters, and the like. The RAM 64 is a storage medium that is used as a work area or the like at the time of executing the respective types of programs. The NVM 66 is a non-volatile storage medium that stores various types of information that must be retained even if the power source switch of the device is turned off.

The communication interface 68 is connected to the transfer medium 58, and is for receiving various types of information (e.g., the first synthesized signal) via the transfer medium 58 from the sound collecting device 52 or a terminal device such as a personal computer or the like, and is for transmitting various types of information (e.g., information expressing the operation status of the sound output device 54) via the transfer medium 58 to the sound collecting device 52 or a personal computer or the like. Note that, in the present fourth exemplary embodiment, a modem is used as the communication interface 68.

The CPU 60, the ROM 62, the RAM 64, the NVM 66, the communication interface 68, and the D/A converter 30 are connected to one another via a bus BUS2 such as a system bus or the like. Accordingly, the CPU 60 can respectively carry out access to the ROM 62, the RAM 64 and the NVM 66, reception of various types of information from the sound collecting device 52 via the communication interface 68, transmission of various types of information to the sound collecting device 52 via the external interface 68, and transmission of digital signals to the D/A converter 30.

Operation of the acoustic communication system 54 relating to the present fourth exemplary embodiment is described next.

Figure 11:
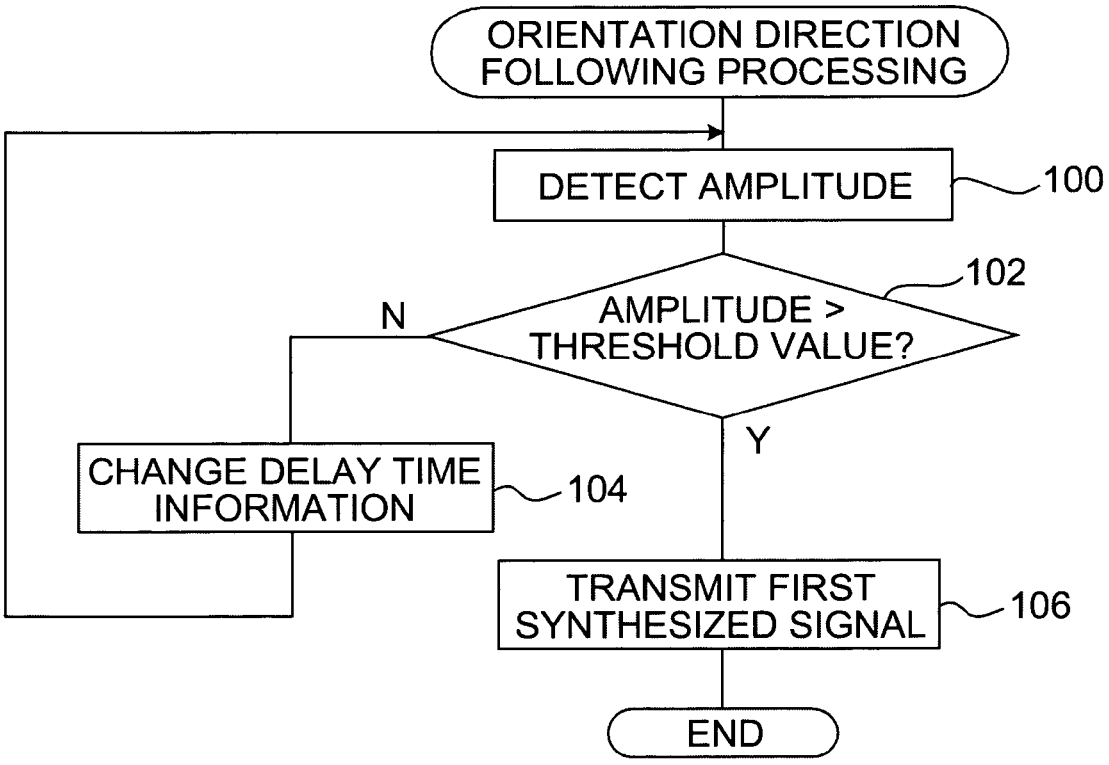
FIG. 11 is a flowchart showing the flow of processings of an orientation direction following processing program relating to the fourth exemplary embodiment.

First, operation of the sound collecting device 52 at the time of executing orientation direction following processing relating to the present fourth exemplary embodiment will be described with reference to FIG. 11. Note that FIG. 11 is a flowchart showing the flow of processings of the orientation direction following processing program relating to the present fourth exemplary embodiment that is executed by the CPU 18 each predetermined time when the power source of the sound collecting device 52 is turned on. The flowchart shown in FIG. 11 differs from the flowchart shown in FIG. 5 with respect to the point that step 106 is newly provided. Therefore, in FIG. 11, steps that carry out the same processings as in the flowchart shown in FIG. 5 are denoted by the same step numbers as in FIG. 5, and description thereof is omitted. Here, the point that differs from the flowchart shown in FIG. 5 is described.

When the judgment in step 102 of FIG. 11 is negative, the routine moves on to step 104. On the other hand, when the judgment is affirmative, the routine moves on to step 106, and the first synthesized signal that is being generated at the present point in time is transmitted to the sound output device 54 via the communication interface 56. Thereafter, the present orientation direction following processing program ends.

Figure 12:
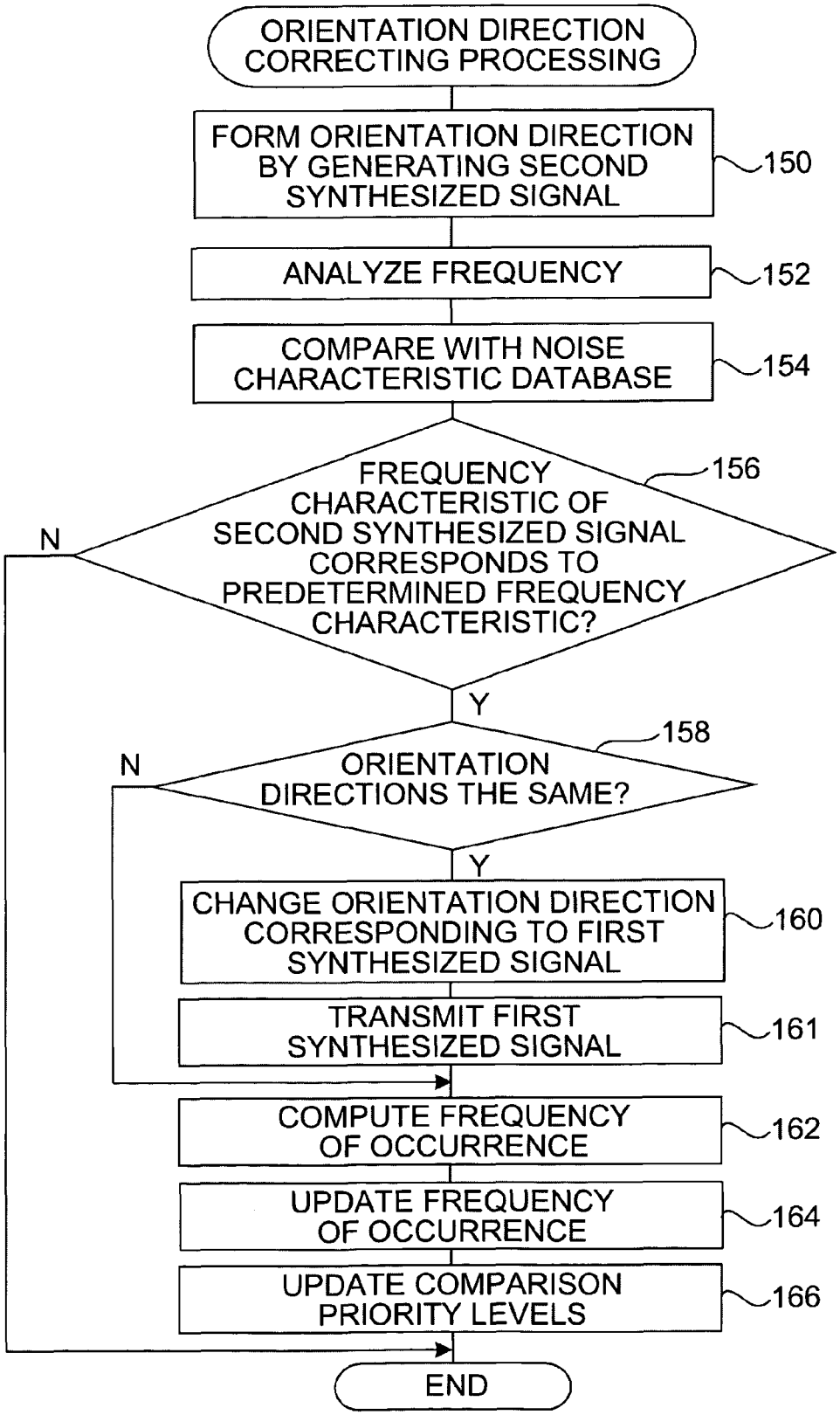
FIG. 12 is a flowchart showing the flow of processings of an orientation direction correcting processing program relating to the fourth exemplary embodiment.

Next, operation of the sound collecting device 52 at the time when orientation direction correcting processing relating to the present fourth exemplary embodiment is executed is described with reference to FIG. 12. Note that FIG. 12 is a flowchart showing the flow of processings of an orientation direction correcting processing program relating to the present fourth exemplary embodiment that is executed by the CPU 18 each predetermined time when the power source of the sound collecting device 52 is turned on. The flowchart shown in FIG. 12 differs from the flowchart shown in FIG. 6 with respect to the point that step 161 is newly provided. Therefore, in FIG. 12, steps that carry out the same processings as in the flowchart shown in FIG. 6 are denoted by the same step numbers as in FIG. 6, and description thereof is omitted. Here, the point that differs from the flowchart shown in FIG. 6 is described.

When the processing of step 160 in FIG. 12 ends, the routine moves on to step 161, and the first synthesized signal generated in step 160 is transmitted to the sound output device 54 via the communication interface 56. Thereafter, the present orientation direction correcting processing program ends.

Figure 13:
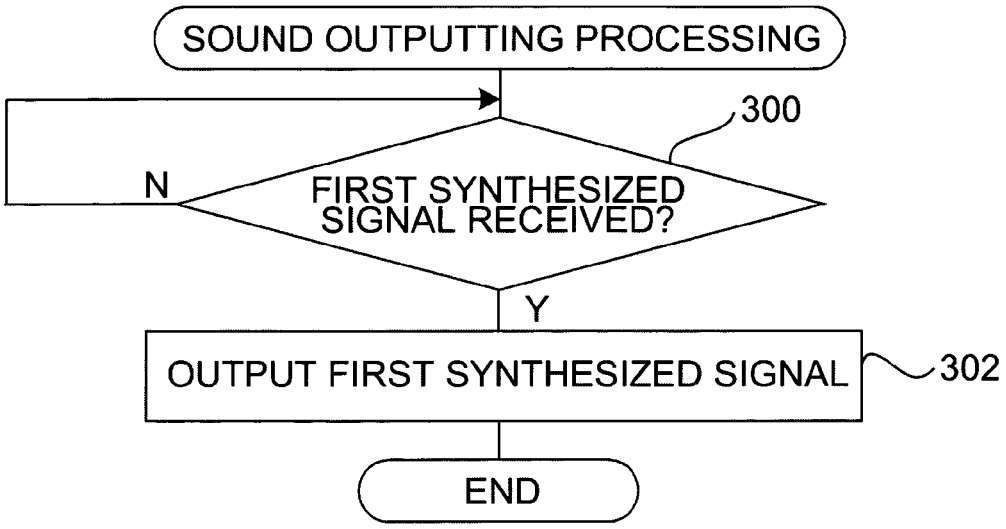
FIG. 13 is a flowchart showing the flow of processings of a sound outputting processing program relating to the fourth exemplary embodiment.

Next, operation of the sound output device 54 at the time when sound outputting processing is executed is described with reference to FIG. 13. FIG. 13 is a flowchart showing the flow of processings of a sound outputting processing program relating to the present fourth exemplary embodiment that is executed each predetermined time (e.g., 0.1 sec) by the CPU 60 when the power source of the sound output device 54 is turned on.

In step 300 of FIG. 13, the routine stands-by until the first synthesized signal transmitted from the sound collecting device 52 is received. Thereafter, the routine moves on to step 302, and the first synthesized signal received in above step 300 is outputted to the D/A converter 30. Thereafter, the present sound outputting processing program ends.

Note that the present fourth exemplary embodiment describes, as an example, a case in which the orientation direction following processing and orientation direction correcting processing relating to the first and second exemplary embodiments are applied to the sound collecting device 52 relating to the present fourth exemplary embodiment. However, the sound input/output processing relating to the third exemplary embodiment may, of course, be applied to the sound collecting device 52 relating to the present fourth exemplary embodiment.

Figure 14:
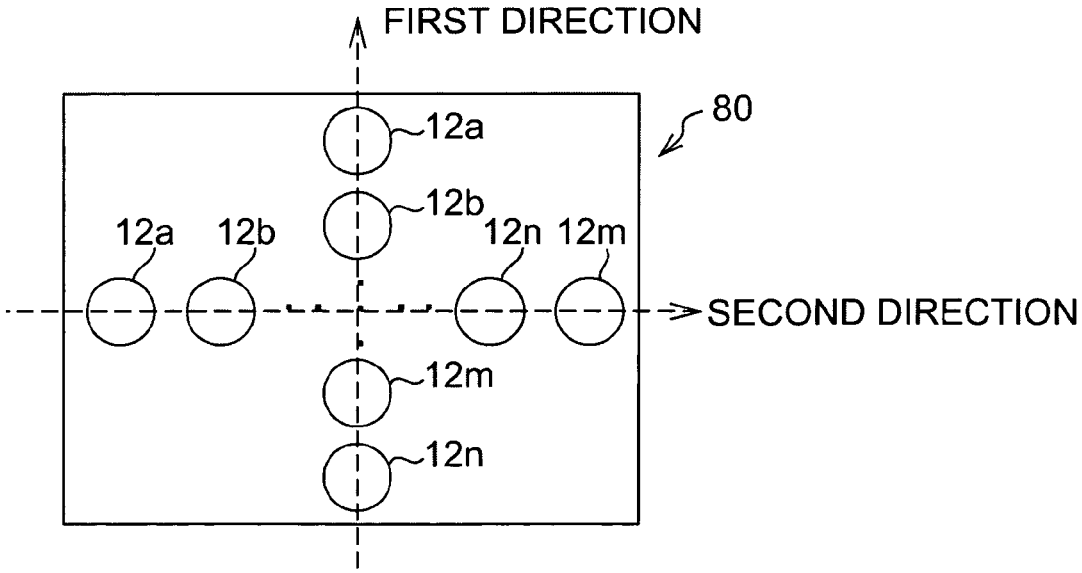
FIG. 14 is a front view showing a modified example of a microphone array relating to the exemplary embodiments.

Each of the above exemplary embodiments describe an example of a case using the microphone array 12 that is structured by the microphones 12*a* through 12*n* that are arrayed in a rectilinear form in one direction, but the present invention is not limited to the same. As shown in FIG. 14 as an example, the microphone array 12 may be used that is structured by the microphones 12*a* through 12*n* that are arrayed in rectilinear forms respectively in two directions that are a first direction (e.g., a vertical direction) and a second direction (e.g., a horizontal direction) that is a direction substantially orthogonal to the first direction. An example of a form in this case is that separate speakers 16 output a first synthesized signal corresponding to the first direction and a first synthesized signal corresponding to the second direction, that are obtained by executing the processings described in the above first through fourth exemplary embodiments on the acoustic signals collected at the respective microphones 12*a* through 12*n* that are arrayed in the first direction and the acoustic signals collected at the respective microphones 12*a* through 12*n* that are arrayed in the second direction. In this way, the microphone array 12, that is structured by the microphones 12*a* through 12*n* being arrayed in rectilinear forms in plural directions, may be used. Note that the microphones 12*a* through 12*n* do not necessarily have to be arrayed rectilinearly, and, for example, may be arrayed in an arc-shaped form.

The above second exemplary embodiment describes, as an example, a case of using the noise characteristic database shown in FIG. 8. However, the present invention is not limited to the same. For example, as shown in FIG. 15, a noise characteristic database for each of directions A through C may be readied. In this case, in step 154A of the flowchart shown in FIG. 6, comparison is carried out by using, among the noise characteristic databases of directions A through C, the noise characteristic database of the direction corresponding to the direction of directivity formed by generating the second synthesized signal in step 150 of the flowchart shown in FIG. 6.

Software structures, by which the orientation direction following processing and the orientation direction correcting processing relating to the above first and second exemplary embodiments are respectively realized by executing an orientation direction following processing program and an orientation direction correcting processing program, have been described as example. However, the present invention is not limited to the same. As shown as an example in FIG. 16, the orientation direction following processing and the orientation direction correcting processing may be realized by hardware structures.

Figure 16:
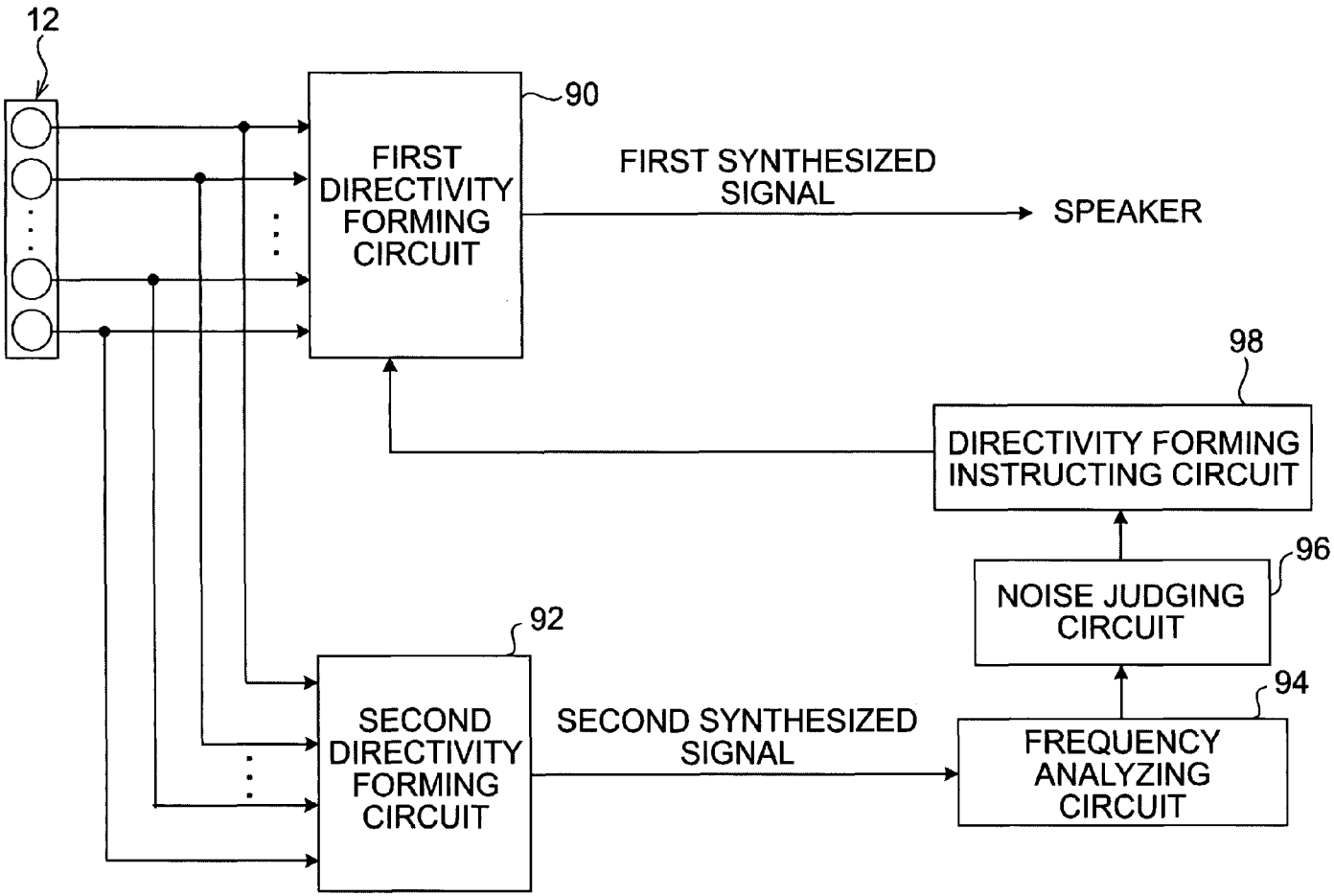
FIG. 16 is a schematic drawing showing a structure for realizing, by hardware structures, sound input/output processings relating to the first and second exemplary embodiments.

The output terminals of microphones 12*a* through 12*n* in FIG. 16 are connected to respective input terminals of a first directivity forming circuit 90 and a second directivity forming circuit 92. The output terminal of the first directivity forming circuit 90 is connected, via a D/A converter and an amplifier, to the input terminal of a speaker. The output terminal of the second directivity forming circuit 92 is connected to the input terminal of a frequency analyzing circuit 94. The output terminal of the frequency analyzing circuit 94 is connected to the input terminal of a noise judging circuit 96. The output terminal of the noise judging circuit 96 is connected to the input terminal of a directivity forming instructing circuit 98. The output terminal of the directivity forming instructing circuit 98 is connected to an input terminal of the first directivity forming circuit 90.

In FIG. 16, the first directivity forming circuit 90 is a circuit for executing the processings of step 104 of the flowchart shown in FIG. 5 and step 160 of the flowchart shown in FIG. 6, and forms the orientation direction of the microphone array 12 in any direction among directions A through C by generating the first synthesized signal. The second directivity forming circuit 92 is a circuit for executing the processing of step 150 of the flowchart shown in FIG. 6. The frequency analyzing circuit 94 is a circuit for executing the processing of step 152 of the flowchart shown in FIG. 6. The noise judging circuit 96 is a circuit for executing the processings of steps 156, 158 of the flowchart shown in FIG. 6. The directivity forming instructing circuit 98 is a circuit for executing the processing of step 160 of the flowchart shown in FIG. 6, and is for setting, at the first directivity forming circuit 90, delay times corresponding to the respective microphones 12*a* through 12*n* that are used for generating the first synthesized signal at the first directivity forming circuit 90.

The orientation direction following processing and the orientation direction correcting processing relating to the above first and second exemplary embodiments may, of course, be realized by a combination of hardware structures and software structures. In this case, for example, there may be a form in which the processings, that are carried out by the respective circuits that are the frequency analyzing circuit 94, the noise judging circuit 96 and the directivity forming instructing circuit 98 shown in FIG. 16, are realized by software structures by executing programs by using a computer.

A plurality of the second directivity forming circuits 92 shown in FIG. 16 may be connected in parallel. In this case, a second synthesized signal is generated at each of the second directivity forming circuits 92. Due thereto, plural directionalities are formed simultaneously. Therefore, by analyzing the frequency characteristics of the respective second synthesized signals at the frequency analyzing circuit 94, it is possible to judge the existence of the occurrence of noises with respect to plural directions simultaneously, and sound in which even less noise is mixed in can be collected and outputted. Note that the plural second synthesized signals can of course be generated by software structures as well, in the same way as by hardware structures.

Figure 17:
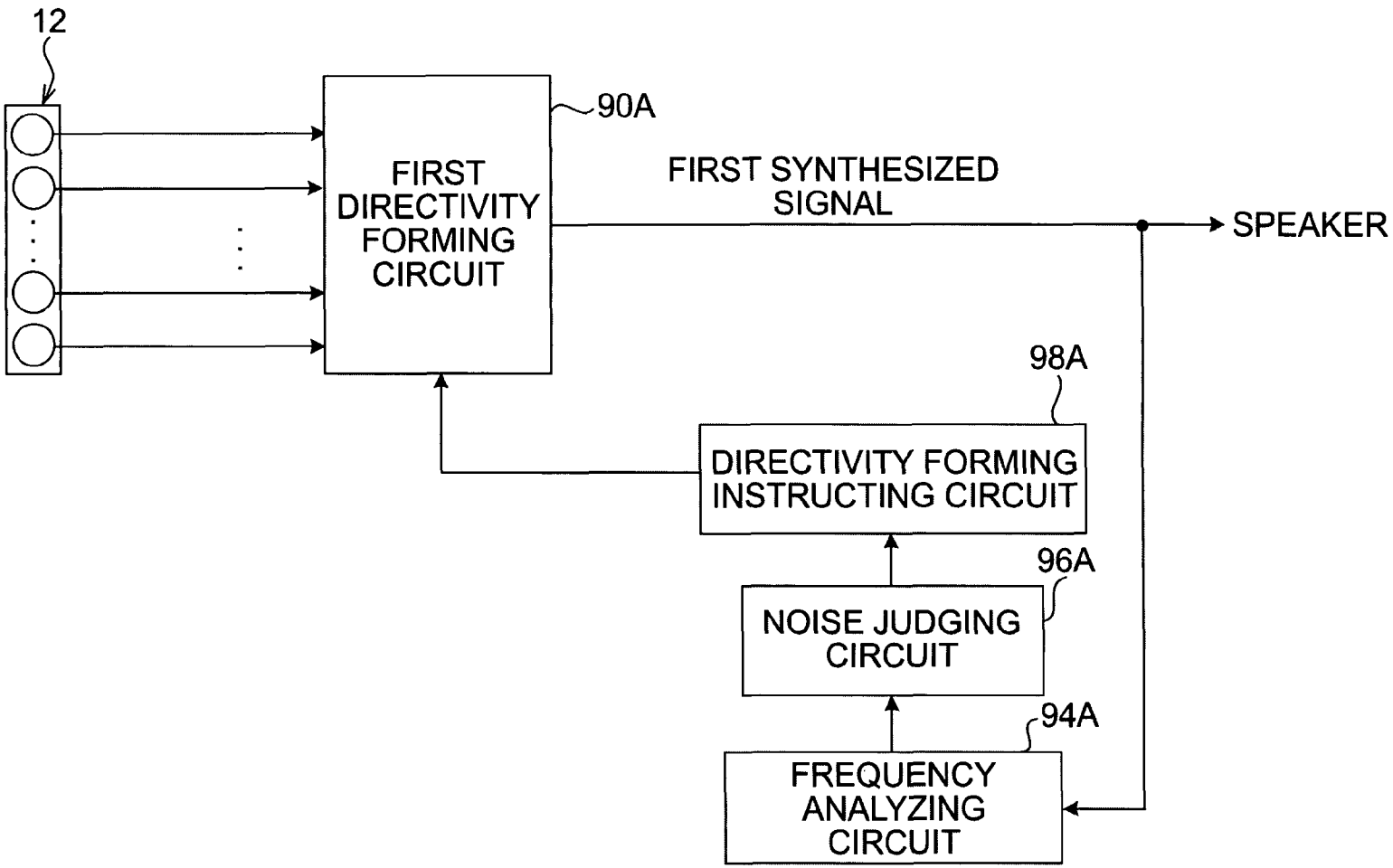
FIG. 17 is a schematic drawing showing a structure for realizing, by hardware structures, sound input/output processing relating to the third exemplary embodiment.

Software structures, by which the respective sound input/output processings relating to the third exemplary embodiment are realized by executing sound input/output processing programs, have been described as an example, but the present invention is not limited to the same. As shown in FIG. 17 as an example, the sound input/output processings may be realized by hardware structures.

The output terminals of the microphones 12*a* through 12*n* of FIG. 17 are connected to the input terminals of a first directivity forming circuit 90A. The output terminal of the first directivity forming circuit 90A is connected, via a D/A converter and an amplifier, to the input terminal of a speaker. The output terminal of the first directivity forming circuit 90A is connected to the input terminal of a frequency analyzing circuit 94A. The output terminal of the frequency analyzing circuit 94A is connected to the input terminal of a noise judging circuit 96A. The output terminal of the noise judging circuit 96A is connected to the input terminal of a directivity forming instructing circuit 98A. The output terminal of the directivity forming instructing circuit 98A is connected to an input terminal of the first directivity forming circuit 90A.

In FIG. 17, the first directivity forming circuit 90A is a circuit for executing the processing of step 208 of the flowchart shown in FIG. 9. The frequency analyzing circuit 94A is a circuit for executing the processing of step 200 of the flowchart shown in FIG. 9. The noise judging circuit 96A is a circuit for executing the processing of step 204 of the flowchart shown in FIG. 9. The directivity forming instructing circuit 98A is a circuit for executing the processing of step 208 of the flowchart shown in FIG. 9. Further, the sound input/output processings may, of course, be realized by a combination of hardware structures and software structures. In this case, for example, there may be a form in which the processings, that are carried out by the respective circuits that are the frequency analyzing circuit 94A and the noise judging circuit 96A shown in FIG. 17, are realized by software structures by executing programs by using a computer.

In each of the above exemplary embodiments, the voiced sound number of times is determined by using an envelope, but the present invention is not limited to the same. For example, the voiced sound number of times may be determined by monitoring the peak values of the frequency waveform itself of the second synthesized signal.

Although the respective exemplary embodiments describe, as examples, cases in which the voiced sound number of times is used as the frequency characteristic, the present invention is not limited to the same. For example, the number of times that the slope of the tangent in the graph of the time-amplitude characteristic shown in FIG. 7B is greater than or equal to a predetermined slope, may be used as the frequency characteristic. Or, the number of times of peaks that arise in a predetermined time (e.g., 0.3 seconds) of the graph of the time-amplitude characteristic shown in FIG. 7B may be used as the frequency characteristic.

Cases in which the frequency characteristics of plural frequency bands are compared are described as examples in the above exemplary embodiments, but the present invention is not limited to the same, and the frequency characteristic of a single frequency band may be compared.

The respective exemplary embodiments describe, as examples, cases in which the existence of noise is judged by judging whether or not the frequency characteristic of the second synthesized signal coincides with a frequency characteristic of the noise characteristic database. However, the present invention is not limited to the same. The existence of noise may be judged by judging whether or not the frequency characteristic of the second synthesized signal and a frequency characteristic of the noise characteristic database coincide so as to include a predetermined error.

In the above second exemplary embodiment, a case in which information expressing each of directions A through C are used as the direction information is described as an example, but the present invention is not limited to the same. The direction information may be structured so as to include information expressing each of plural directions.

Although noises A through C are used as the noises that are the objects of comparison in the above respective exemplary embodiments, the present invention is not limited to the same, and it suffices for there to be plural noises that are objects of comparison.

The above exemplary embodiments describe, as examples, cases in which the first synthesized signal is outputted to the speaker, but the present invention is not limited to the same. For example, the first synthesized signal may be outputted to a recording device that records sound. In this way, the device that serves as the destination of output of the first synthesized signal can be changed in accordance with the application.

Cases in which the various types of processing programs are stored in advance in the ROM are described as examples in the above respective exemplary embodiments, but the present invention is not limited to the same. A form may be used that provides the various types of processing programs in a state of being stored on a recording medium that is read by a computer, such as a CD-ROM, a DVD-ROM, a USB (Universal Serial Bus) memory, or the like. Or, a form may be used in which the various types of processing programs are distributed via a wired or wireless communication section.

What is claimed is:

1. A sound collecting device comprising:

a microphone array having a plurality of sound-collecting microphones, the plurality of sound-collecting microphones being arrayed in a direction intersecting a predetermined direction such that respective orientation directions of the plurality of sound-collecting microphones are directed in the predetermined direction; and a computer configured with one or more programs that, in response to execution, implement sections including an orientation direction forming section, stored in a memory device, that forms an orientation direction of the microphone array by synthesizing acoustic signals outputted from the respective sound-collecting microphones, in a state in which phase differences between the acoustic signals corresponding to differences in arrival times at the respective sound-collecting microphones of sounds from the formed orientation direction are eliminated;

a control section, stored in the memory device, that compares a characteristic of a synthesized signal obtained by synthesizing the acoustic signals with noise type information to make a determination whether the synthesized signal corresponds to a sound other than a target sound, and controls the orientation direction forming section to form an orientation direction of the microphone array based on the determination;

an associating section that computes frequencies of occurrence of sounds collected by the sound-collecting microphones; and a changing section that changes comparison priority levels stored in a database, based on the frequencies of occurrence computed by the associating section, the comparison priority levels determining a priority of comparison of the synthesized signal with the noise type information;

wherein the control section compares the characteristic of the synthesized signal with the noise type information in an order determined by the comparison priority levels.

2. The sound collecting device of claim 1, wherein the associating section computes the frequencies of occurrence of the collected sounds for each of a plurality of orientation directions, and associates the computed frequencies of occurrence with orientation directions, the changing section changes the comparison priority levels per orientation direction, and in accordance with the comparison priority levels corresponding to the orientation direction at a present point in time, the control section compares a frequency characteristic of the collected sounds with a frequency characteristic of the synthesized signal, the frequency characteristic corresponding to a number of times that an amplitude in a predetermined frequency band exceeds a predetermined threshold value.

3. The sound collecting device of claim 1, wherein if the characteristic of the synthesized signal obtained by synthesizing the acoustic signals corresponds to a sound other than a target sound, the control section controls the orientation direction forming section such that an orientation direction of the microphone array different from an orientation direction of the microphone array at a present point in time is formed, and if the characteristic of the synthesized signal does not correspond to a sound other than the target sound, the control section controls the orientation direction forming section such that an orientation direction of the microphone array same as the orientation direction of the microphone array at the present point in time is formed.

4. The sound collecting device of claim 1, wherein if the characteristic of the synthesized signal corresponds to any of a plurality of sounds other than the target sound, the control section controls the orientation direction forming section such that an orientation direction of the microphone array different from an orientation direction of the microphone array at a present point in time is formed, and if the characteristic of the synthesized signal does not correspond to any of the plurality of sounds other than the target sound, the control section controls the orientation direction forming section such that an orientation direction of the microphone array same as the orientation direction of the microphone array at the present point in time is formed.

5. An acoustic communication system comprising:

the sound collecting device of claim 1 having a transmitting section that transmits a synthesized signal obtained by the orientation direction forming section; and a sound output device having a receiving section that receives the synthesized signal transmitted by the transmitting section, and an outputting section that outputs a sound corresponding to the synthesized signal received by the receiving section.

6. A non-transitory computer-readable storage medium storing a program for causing a computer to function as:

a plurality of orientation direction forming sections that respectively form an orientation direction of a microphone array having a plurality of sound-collecting microphones that respectively output acoustic signals corresponding to collected sounds and in which the plurality of sound-collecting microphones are arrayed in a direction intersecting a predetermined direction such that respective orientation directions of the plurality of sound-collecting microphones are directed in the predetermined direction, by synthesizing acoustic signals outputted from the respective sound-collecting microphones of the microphone array, in a state in which phase differences between the acoustic signals corresponding to differences in arrival times at the respective sound-collecting microphones of sounds from a formed orientation direction are eliminated; and a control section that compares a characteristic of a synthesized signal obtained by synthesizing the acoustic signals with noise type information to make a determination whether the synthesized signal corresponds to a sound other than a target sound, and controls the orientation direction forming section to form an orientation direction of the microphone array based on the determination;

an associating section that computes frequencies of occurrence of sounds collected by the plurality of sound-collecting microphones; and a changing section that changes comparison priority levels stored in a database, based on the frequencies of occurrence computed by the associating section, the comparison priority levels determining a priority of comparison of the synthesized signal with the noise type information;

wherein the control section compares the characteristic of the synthesized signal with the noise type information in an order determined by the comparison priority levels.

7. The non-transitory computer-readable storage medium of claim 6, wherein if the characteristic of the synthesized signal obtained by synthesizing the acoustic signals corresponds to a sound other than a target sound, the control section controls the orientation direction forming section such that an orientation direction of the microphone array different from an orientation direction of the microphone array at a present point in time is formed, and if the characteristic of the synthesized signal does not correspond to a sound other than the target sound, the control section controls the orientation direction forming section such that an orientation direction of the microphone array same as the orientation direction of the microphone array at the present point in time is formed.

8. The non-transitory computer-readable storage medium of claim 6, wherein if the characteristic of the synthesized signal corresponds to any of a plurality of sounds other than the target sound, the control section controls the orientation direction forming section such that an orientation direction of the microphone array different from an orientation direction of the microphone array at a present point in time is formed, and if the characteristic of the synthesized signal does not correspond to any of the plurality of sounds other than the target sound, the control section controls the orientation direction forming section such that an orientation direction of the microphone array same as the orientation direction of the microphone array at the present point in time is formed.

* * * * *